US011125090B2

(12) United States Patent
Miyahisa et al.

(10) Patent No.: US 11,125,090 B2
(45) Date of Patent: Sep. 21, 2021

(54) FIRST-STAGE STATIONARY VANE OF GAS TURBINE AND GAS TURBINE

(71) Applicant: Mitsubishi Hitachi Power Systems, Ltd., Yokohama (JP)

(72) Inventors: Yasuo Miyahisa, Yokohama (JP); Satoshi Hada, Yokohama (JP); Susumu Wakazono, Yokohama (JP); Hitoshi Kitagawa, Tokyo (JP); Takashi Hiyama, Tokyo (JP)

(73) Assignee: MITSUBISHI POWER, LTD., Yokohama (JP)

( * ) Notice: Subject to any disclaimer, the term of this patent is extended or adjusted under 35 U.S.C. 154(b) by 96 days.

(21) Appl. No.: 16/561,496

(22) Filed: Sep. 5, 2019

(65) Prior Publication Data

US 2020/0088047 A1 Mar. 19, 2020

(30) Foreign Application Priority Data

Sep. 13, 2018 (JP) ..... JP2018-171522

(51) Int. Cl.

| | |
|---|---|
| ***F01D 5/14*** | (2006.01) |
| ***F01D 9/04*** | (2006.01) |
| ***F01D 9/02*** | (2006.01) |
| ***F01D 25/06*** | (2006.01) |

(52) U.S. Cl.

CPC ..... *F01D 9/041* (2013.01); *F01D 5/141* (2013.01); *F01D 5/147* (2013.01); *F01D 9/023* (2013.01); *F01D 25/06* (2013.01); *F05D 2220/3212* (2013.01); *F05D 2240/12* (2013.01); *F05D 2240/121* (2013.01); *F05D 2240/123* (2013.01); *F05D 2240/124* (2013.01); *F05D 2240/35* (2013.01); *F05D 2260/96* (2013.01)

(58) Field of Classification Search

CPC ..... F01D 5/141; F01D 5/147; F01D 9/023; F01D 9/041; F05D 2220/3212; F05D 2240/121; F05D 2204/123; F05D 2240/124; F05D 2240/35; F02C 3/14

See application file for complete search history.

(56) References Cited

U.S. PATENT DOCUMENTS

| | | | | |
|---|---|---|---|---|
| 7,249,933 | B2 * | 7/2007 | Lee | F01D 5/145 416/97 R |
| 9,334,743 | B2 * | 5/2016 | Alvanos | F01D 9/041 |
| 10,408,227 | B2 * | 9/2019 | Bailey | F01D 9/041 |
| 2011/0206522 | A1 * | 8/2011 | Alvanos | F01D 5/282 416/204 R |

(Continued)

*Primary Examiner* — Ninh H. Nguyen

(74) *Attorney, Agent, or Firm* — Westerman, Hattori, Daniels & Adrian, LLP

(57) ABSTRACT

A first-stage stationary vane of a gas turbine includes: a vane portion including a pressure surface and a suction surface; a shroud wall portion which connects to an end portion of the vane portion and which forms a flow passage wall; a pressure-surface side fillet portion disposed on a corner portion formed by the pressure surface and a wall surface of the shroud wall portion; and a suction-surface side fillet portion disposed on a corner portion formed by the suction surface and the wall surface of the shroud wall portion. The pressure-surface side fillet portion and the suction-surface side fillet portion are separated at a leading-edge side of the vane portion so as not to connect to each other.

12 Claims, 13 Drawing Sheets

(56) References Cited

U.S. PATENT DOCUMENTS

| | | | | |
|---|---|---|---|---|
| 2014/0260279 | A1* | 9/2014 | DiCintio | F23R 3/005 60/752 |
| 2016/0123166 | A1* | 5/2016 | Ols | F01D 9/04 415/210.1 |
| 2016/0177756 | A1 | 6/2016 | Potter et al. | |
| 2016/0251969 | A1* | 9/2016 | Boeke | F01D 9/065 415/115 |

* cited by examiner

FIRST-STAGE STATIONARY VANE OF GAS TURBINE AND GAS TURBINE

TECHNICAL FIELD

The present disclosure relates to a first-stage stationary vane of a gas turbine and a gas turbine.

BACKGROUND ART

A stationary vane of a typical gas turbine includes a vane portion that has a pressure surface and a suction surface, a shroud wall portion that connects to an end portion of the vane portion and forms a flow passage wall, a pressure-surface side fillet portion disposed on a corner portion formed by the pressure surface and a wall surface of the shroud wall portion, and a suction-surface side fillet portion formed on a corner portion formed by the suction surface and a wall surface of the shroud wall portion (e.g. Patent Document 1).

CITATION LIST

Patent Literature

Patent Document 1: US Patent Application Publication No. 2016/0177756

SUMMARY

Meanwhile, in a gas turbine including a plurality of combustors, combustion vibration may occur near the outlet portions of the combustors due to acoustic transmission between the combustors. Such combustion vibration may hinder stable operation of the gas turbine.

To suppress such combustion vibration, the first-stage stationary vane of the gas turbine may be disposed proximate to the outlet portions of the combustors. However, in such a case, if a fillet portion is disposed over the entire periphery of the vane portion at the boundary to the shroud wall portion as in Patent Document 1, the fillet portion on the leading edge side of the vane portion may hinder reduction of the distance between the vane portion and the outlet portions of the combustors, which limits the effect to reduce combustion vibration.

At least one embodiment of the present invention was made in view of the above conventional problem. An object of at least one embodiment of the present invention is to provide a first-stage stationary vane and a gas turbine capable of reducing combustion vibration between the outlet portions of the plurality of combustors caused by acoustic transmission.

(1) According to at least one embodiment of the present invention, a first-stage stationary vane of a gas turbine includes: a vane portion including a pressure surface and a suction surface; a shroud wall portion which connects to an end portion of the vane portion and which forms a flow passage wall; a pressure-surface side fillet portion disposed on a corner portion formed by the pressure surface and a wall surface of the shroud wall portion; and a suction-surface side fillet portion disposed on a corner portion formed by the suction surface and the wall surface of the shroud wall portion. The pressure-surface side fillet portion and the suction-surface side fillet portion are separated at a leading-edge side of the vane portion so as not to connect to each other.

With the first-stage stationary vane of a gas turbine according to the above (1), the pressure-surface side fillet portion and the suction-surface side fillet portion are separated at the leading edge side of the vane portion so as not to connect to each other, and thus the pressure-surface side fillet portion and the suction-surface side fillet portion are less likely to hinder reduction of the distance between the outlet portions of the combustors and the vane portion, compared to a case where a fillet is disposed along the entire periphery of the vane portion at the boundary to the shroud wall portion as described in Patent Document 1. Thus, it is possible to block acoustic transmission between the outlet portions of the plurality of combustors by reducing the distance between the outlet portions of the combustors and the vane portion, and reduce combustion vibration effectively.

In the above (1), and (2) to (12) below, "shroud wall portion" may be an outer shroud wall portion connected to a radial-directional outer end portion of the vane portion, or an inner shroud wall portion connected to a radial-directional inner end portion of the vane portion.

(2) In some embodiments, in the first-stage stationary vane of a gas turbine according to the above (1), an upstream-side end portion of the vane portion includes an upstream-side end surface which connects the pressure surface and the suction surface, and the upstream-side end surface includes a flat surface which connects to the shroud wall portion.

With the above first-stage stationary vane of a gas turbine (2), by arranging a flat surface so as to proximately face the radial-directional wall portions of the outlet portions of the combustors, it is possible to reduce the gap between the flat surface and the radial-directional wall portions over a broad range in the circumferential direction. Accordingly, it is possible to block acoustic transmission between the outlet portions of the plurality of combustors, and reduce combustion vibration effectively.

(3) In some embodiments, in the first-stage stationary vane of a gas turbine according to the above (2), an upstream-side end surface of the pressure-surface side fillet portion and an upstream-side end surface of the suction-surface side fillet portion are formed so as not to protrude upstream from the flat surface.

With the above first-stage stationary vane for a gas turbine (3), the pressure-surface side fillet portion and the suction-surface side fillet portion are less likely to hinder reduction of the distance between the outlet portions of the combustors and the vane portion at the leading edge side of the vane portion, compared to a case where the upstream-side end surface of the pressure-surface side fillet portion and the upstream-side end surface of the suction-surface side fillet portion protrude upstream from the flat surface. Thus, it is possible to block acoustic transmission between the outlet portions of the plurality of combustors by reducing the distance between the outlet portions of the combustors and the vane portion, and reduce combustion vibration effectively.

(4) In some embodiments, in the first-stage stationary vane of a gas turbine according to any one of the above (1) to (3), an upstream-side end surface of the pressure-surface side fillet portion is defined by a curve which smoothly connects the pressure surface and the wall surface of the shroud portion, a first segment which extends from a first end of the curve to the wall surface of the shroud wall portion along a vane height direction, and a second segment which extends from a joint portion between the first segment and the wall surface of the shroud wall portion to a second end of the curve.

At the outlet portion of a typical combustor, the corner portion of each of the radial-directional wall portion and the circumferential-directional wall portion has a round shape. Thus, with the upstream-side end surface of the pressure-surface side fillet portion having a shape defined by the above curve and the above two segments as described in the above (4), when the upstream-side end surface of the pressure-surface side fillet portion faces one of the corner portions of the outlet portions of the combustors, it is possible to eliminate or reduce the step between the pressure-surface side fillet portion and the corner portion of the outlet portion of the combustor. Accordingly, it is possible to suppress separation of flow due to the step, and suppress efficiency deterioration of the gas turbine.

(5) In some embodiments, in the first-stage stationary vane of a gas turbine according to any one of the above (1) to (4), an upstream-side end surface of the suction-surface side fillet portion is defined by a curve which smoothly connects the suction surface and the wall surface of the shroud portion, a first segment which extends from a first end of the curve to the wall surface of the shroud wall portion along a vane height direction, and a second segment which extends from a joint portion between the first segment and the wall surface of the shroud wall portion to a second end of the curve.

At the outlet portion of a typical combustor, the corner portion of each of the radial-directional wall portion and the circumferential-directional wall portion has a round shape. Thus, with the upstream-side end surface of the suction-surface side fillet portion having a shape defined by the above curve and the above two segments as described in the above (5), when the upstream-side end surface of the suction-surface side fillet portion faces one of the corner portions of the outlet portions of the combustors, it is possible to eliminate or reduce the step between the suction-surface side fillet portion and the corner portion of the outlet portion of the combustor. Accordingly, it is possible to suppress separation of flow due to the step, and suppress efficiency deterioration of the gas turbine.

(6) In some embodiments, in the first-stage stationary vane of a gas turbine according to any one of the above (1) to (5), at least one of the pressure-surface side fillet portion or the suction-surface side fillet portion includes a fillet radius increasing portion where a fillet radius increases toward an upstream side.

At the outlet portions of the combustors of a typical gas turbine, the corner portion of each of the radial-directional wall portion and the circumferential-directional wall portion has a round shape. Further, each of the fillet radius of the pressure-surface side fillet portion and the fillet radius of the suction-surface side fillet portion of a typical stationary vane is smaller than the curvature radius of the corner portion of the outlet portion of each combustor.

Thus, if the first-stage stationary vane is disposed proximate to the outlet portions of the combustors of a typical gas turbine without any measure, steps are formed between the pressure-surface side fillet portion and the corner portions of the outlet portions of the combustors, and between the suction-surface side fillet portion and the corner portions of the outlet portions of the combustors, and the steps cause separation of flow, which leads to efficiency deterioration of the gas turbine.

In contrast, with the above first-stage stationary vane according to the above (6), at least one of the pressure-surface side fillet portion or the suction-surface side fillet portion includes the fillet radius increasing portion where the fillet radius increases toward the upstream side, and thus it is possible to eliminate or reduce at least a part of the above steps. Accordingly, it is possible to suppress separation of flow due to the steps, and suppress efficiency deterioration of the gas turbine.

Further, if a typical stationary vane does not include a fillet radius increasing portion and has a relatively small fillet radius, thermal stress is likely to concentrate on the fillet portion. In contrast, if the first-stage stationary vane includes the fillet radius increasing portion as described in the above (6), the fillet radius is large at the leading-edge side, and thus it is possible to mitigate concentration of thermal stress at the fillet end and reduce the peak value of thermal stress.

(7) According to at least one embodiment of the present invention, a gas turbine includes: a plurality of combustors each of which has an outlet portion including a radial-directional wall portion along a radial direction of a rotor, the plurality of combustors being disposed in a circumferential direction of the rotor; and the first-stage stationary vane according to any one of the above (1) to (6) positioned at a downstream side of a pair of the radial-directional wall portions of the outlet portions of the combustors disposed adjacently in the circumferential direction, the pair of the radial-directional wall portions facing each other.

The gas turbine according to the above (7) includes the first-stage stationary vane described in any one of the above (1) to (6), and thus it is possible to block acoustic transmission between the outlet portions of the plurality of combustors by reducing the distance between the outlet portions of the combustors and the vane portion, and reduce combustion vibration effectively. Accordingly, it is possible to operate the gas turbine stably.

(8) According to at least one embodiment of the present invention, a first-stage stationary vane of a gas turbine includes: a vane portion including a pressure surface and a suction surface; a shroud wall portion which connects to an end portion of the vane portion and which forms a flow passage wall; a pressure-surface side fillet portion disposed on a corner portion formed by the pressure surface and a wall surface of the shroud wall portion; and a suction-surface side fillet portion disposed on a corner portion formed by the suction surface and the wall surface of the shroud wall portion. The pressure-surface side fillet portion includes a fillet radius increasing portion where a fillet radius increases toward an upstream side, and at least one of the shroud wall portion or the vane portion includes a cut-out portion which is recessed toward the fillet radius increasing portion from a back side of the fillet radius increasing portion.

At the outlet portions of the combustors of a typical gas turbine, the corner portion of each of the radial-directional wall portion and the circumferential-directional wall portion has a round shape. Further, the fillet radius of the pressure-surface side fillet portion of a typical stationary vane is smaller than the curvature radius of the corner portion of the outlet portion of each combustor.

Thus, if the first-stage stationary vane is disposed proximate to the outlet portions of the combustors of a typical gas turbine without any measure, steps are formed between the pressure-surface side fillet portion and the corner portions of the outlet portions of the combustors, and the steps cause separation of flow, which leads to deterioration of efficiency of the gas turbine.

In contrast, with the above first-stage stationary vane according to the above (8), the pressure-surface side fillet portion includes the fillet radius increasing portion where the fillet radius increases toward the upstream side, and thus it is possible to eliminate or reduce the above step. Accordingly, it is possible to suppress separation of flow due to the step, and suppress efficiency deterioration of the gas turbine.

Further, if a typical stationary vane does not include a fillet radius increasing portion and has a relatively small fillet radius, thermal stress is likely to concentrate on the fillet end (root portion of the fillet). In contrast, if the first-stage stationary vane includes the fillet radius increasing portion as described in the above (8), the fillet radius is large at the leading-edge side, and thus it is possible to mitigate concentration of thermal stress at the fillet end and reduce the peak value of thermal stress.

Furthermore, in a case where the fillet radius is increased by providing the fillet radius increasing portion on the pressure-surface side fillet portion without any measure, the metal temperature of the thick portion of the fillet radius increasing portion increases, and the thick portion pushes the fillet portion and generates a high stress.

In this regard, by providing the cut-out portion as described in the above (8), it is possible to reduce the metal temperature of the thick portion of the fillet radius increasing portion, and reduce stress that is generated at the fillet end.

(9) According to at least one embodiment of the present invention, a first-stage stationary vane of a gas turbine includes: a vane portion including a pressure surface and a suction surface; a shroud wall portion which connects to an end portion of the vane portion and which forms a flow passage wall; a pressure-surface side fillet portion disposed on a corner portion formed by the pressure surface and a wall surface of the shroud wall portion; and a suction-surface side fillet portion disposed on a corner portion formed by the suction surface and the wall surface of the shroud wall portion. The suction-surface side fillet portion includes a fillet radius increasing portion where a fillet radius increases toward an upstream side, and at least one of the shroud wall portion or the vane portion includes a cut-out portion which is recessed toward the fillet radius increasing portion from a back side of the fillet radius increasing portion.

At the outlet portions of the combustors of a typical gas turbine, the corner portion of each of the radial-directional wall portion and the circumferential-directional wall portion has a round shape. Further, the fillet radius of the suction-surface side fillet portion of a typical stationary vane is smaller than the curvature radius of the corner portion of the outlet portion of each combustor.

Thus, if the first-stage stationary vane is disposed proximate to the outlet portions of the combustors of a typical gas turbine without any measure, a step is formed between the suction-surface side fillet portion and the corner portions of the outlet portions of the combustors, and the step causes separation of flow, which leads to deterioration of efficiency of the gas turbine.

In contrast, with the above first-stage stationary vane according to the above (9), the suction-surface side fillet portion includes the fillet radius increasing portion where the fillet radius increases toward the upstream side, and thus it is possible to eliminate or reduce the above step. Accordingly, it is possible to suppress separation of flow due to the step, and suppress efficiency deterioration of the gas turbine.

Further, if a typical stationary vane does not include a fillet radius increasing portion and has a relatively small fillet radius, thermal stress is likely to concentrate on the fillet end (root portion of the fillet). In contrast, the first-stage stationary vane including the fillet radius increasing portion as described in the above (9) has a large fillet radius at the leading-edge side, and thus it is possible to mitigate concentration of thermal stress at the fillet end and reduce the peak value of thermal stress.

In a case where the fillet radius is increased at the upstream side by providing the fillet radius increasing portion on the suction-surface side fillet portion without any measure, the metal temperature of the thick portion of the fillet radius increasing portion increases, and the thick portion pushes the fillet portion and generates a high stress.

In contrast, by providing the cut-out portion as described in the above (9), it is possible to reduce the metal temperature of the thick portion of the fillet radius increasing portion, and reduce stress that is generated at the fillet end.

(10) In some embodiments, in the first-stage stationary vane of a gas turbine according to the above (8) or (9), a downstream end of the cut-out portion is positioned at an upstream side of a downstream end of the fillet radius increasing portion in an axial direction.

In the above configuration (8) or (9), if the cut-out portion extends downstream of the downstream end of the fillet radius increasing portion, the thickness of the pressure-surface side fillet portion or the suction-surface side fillet portion becomes too thin at the downstream side of the downstream end of the fillet radius increasing portion, which may lead to excessive deterioration of the strength of the pressure-surface side fillet portion or the suction-surface side fillet portion.

In contrast, with the downstream end of the cut-out portion being positioned upstream of the downstream end of the fillet radius increasing portion as described in the above (10), it is possible to suppress strength deterioration of the pressure-surface side fillet portion or the suction-surface side fillet portion at the downstream side of the fillet radius increasing portion, while reducing the metal temperature of the thick portion of the fillet radius increasing portion and reducing the stress generated at the fillet end.

(11) In some embodiments, in the first-stage stationary vane of a gas turbine according to any one of the above (8) to (10), the cut-out portion has a cross-sectional area which is orthogonal to a depth direction and which decreases toward a bottom portion of the cut-out portion in the depth direction.

According to the first-stage stationary vane of a gas turbine described in the above (11), the fillet radius increasing portion with a cut-out portion has a more constant thickness, whereby it is possible to effectively reduce the metal temperature of the thick portion of the fillet radius increasing portion, and effectively reduce stress that is generated at the fillet end.

(12) According to at least one embodiment of the present invention, a gas turbine includes: a plurality of combustors each of which has an outlet portion including a radial-directional wall portion along a radial direction of a rotor, the plurality of combustors being disposed in a circumferential direction of the rotor, and the first-stage stationary vane according to any one of the above (8) to (11) positioned at a downstream side of a pair of the radial-directional wall portions of the outlet portions of the combustors disposed adjacently in the circumferential direction, the pair of the radial-directional wall portions facing each other.

The above gas turbine (12) includes the first-stage stationary vane described in any one of the above (8) to (11), and thus it is possible to suppress separation of flow due to the step between the pressure-surface side fillet portion or the suction-surface side fillet portion and the corner portions of the outlet portions of the combustors, and thus it is possible to suppress efficiency deterioration of the gas turbine. Furthermore, the fillet radius at the leading-edge side increases, and thus it is possible to mitigate concentration of thermal stress at the fillet end and reduce the peak value of thermal stress. Furthermore, with the cut-out portion, it is possible to reduce the metal temperature of the thick portion of the fillet radius increasing portion, and reduce stress that is generated at the fillet end.

According to at least one embodiment of the present invention, it is possible to provide a first-stage stationary vane of a gas turbine and a gas turbine capable of reducing combustion vibration that is caused by acoustic transmission between the outlet portions of the plurality of combustors.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
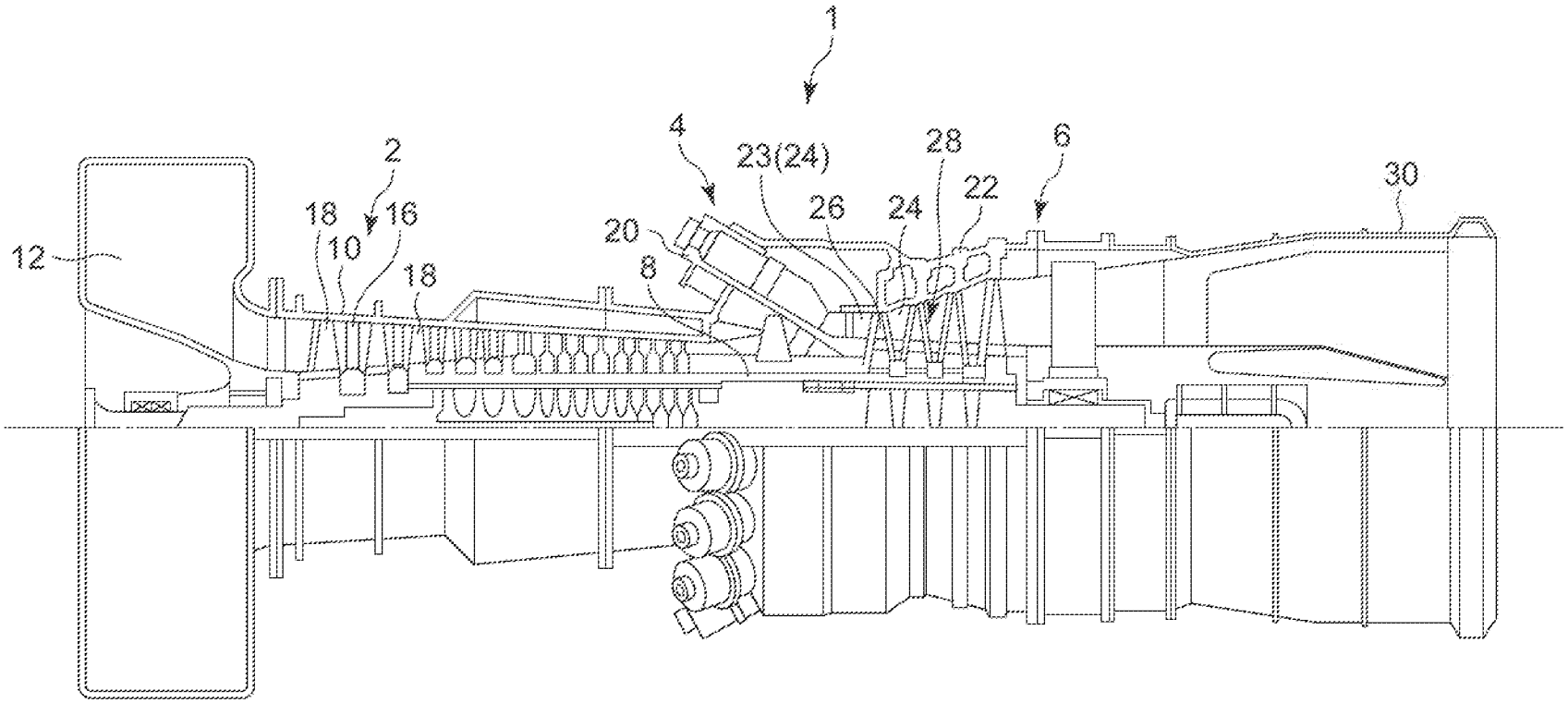
FIG. 1 is a schematic configuration diagram of a gas turbine according to an embodiment.

FIG. 1 is a schematic configuration diagram of a gas turbine according to an embodiment.

As depicted in FIG. 1, the gas turbine 1 includes a compressor 2 for producing compressed air, a combustor 4 for producing combustion gas from the compressed air and fuel, and a turbine 6 configured to be rotary driven by combustion gas. If the gas turbine 1 is for power generation, a generator (not depicted) is connected to the turbine 6.

The compressor 2 includes a plurality of stationary vanes 16 fixed to the side of the compressor casing 10 and a plurality of rotor blades 18 implanted on the rotor 8 so as to be arranged alternately with the stationary vanes 16. The above compressor 2 is supplied with air taken in from an air inlet 12, and the air flows through the plurality of stationary vanes 16 and the plurality of rotor blades 18 to be compressed and turned into compressed air having a high temperature and a high pressure.

The combustor 4 is supplied with fuel and the compressed air produced in the compressor 2, and combusts the fuel to produce combustion gas that serves as a working fluid of the turbine 6. As depicted in FIG. 1, the gas turbine 1 includes a plurality of combustors 4 arranged along the circumferential direction around the rotor 8 inside the casing 20.

The turbine 6 has a combustion gas flow passage 28 formed by the turbine casing 22, and includes a plurality of stationary vanes 24 and a plurality of rotor blades 26 disposed in the combustion gas flow passage 28.

The stationary vanes 24 are fixed to the turbine casing 22, and a plurality of stationary vanes 24 arranged along the circumferential direction of the rotor 8 form a stationary vane row. Furthermore, the rotor blades 26 are implanted on the rotor 8, and a plurality of rotor blades 26 arranged along the circumferential direction of the rotor 8 form a rotor blade row. The rotor blade rows and the stationary vane rows are arranged alternately in the axial direction of the rotor 8. Further, of the plurality of stationary vanes 24, the most upstream stationary vane 24 (i.e. stationary vane 24 that is closest to the combustors 4) is the first-stage stationary vane 23.

In the turbine 6, the rotor 8 is rotary driven by combustion gas that flows from the combustors 4 into the combustion gas flow passage 28 and passes through the plurality of stationary vanes 24 and the plurality of rotor blades 26, and thereby a generator coupled to the rotor 8 is driven and electric power is generated. The combustion gas having driven the turbine 6 is discharged outside via the exhaust chamber 30.

Hereinafter, the axial direction of the gas turbine 1 (axial direction of the rotor 8) is referred to as merely "axial direction", the radial direction of the gas turbine 1 (radial direction of the rotor 8) is referred to as merely "radial direction", and the circumferential direction of the gas turbine 1 (circumferential direction of the rotor 8) is referred to as merely "circumferential direction". Furthermore, with regard to the flow direction of combustion gas in the combustion gas flow passage 28, the upstream side in the axial direction is merely referred to as "upstream side", and the downstream side with respect to the axial direction is merely referred to as "downstream side".

Figure 2:
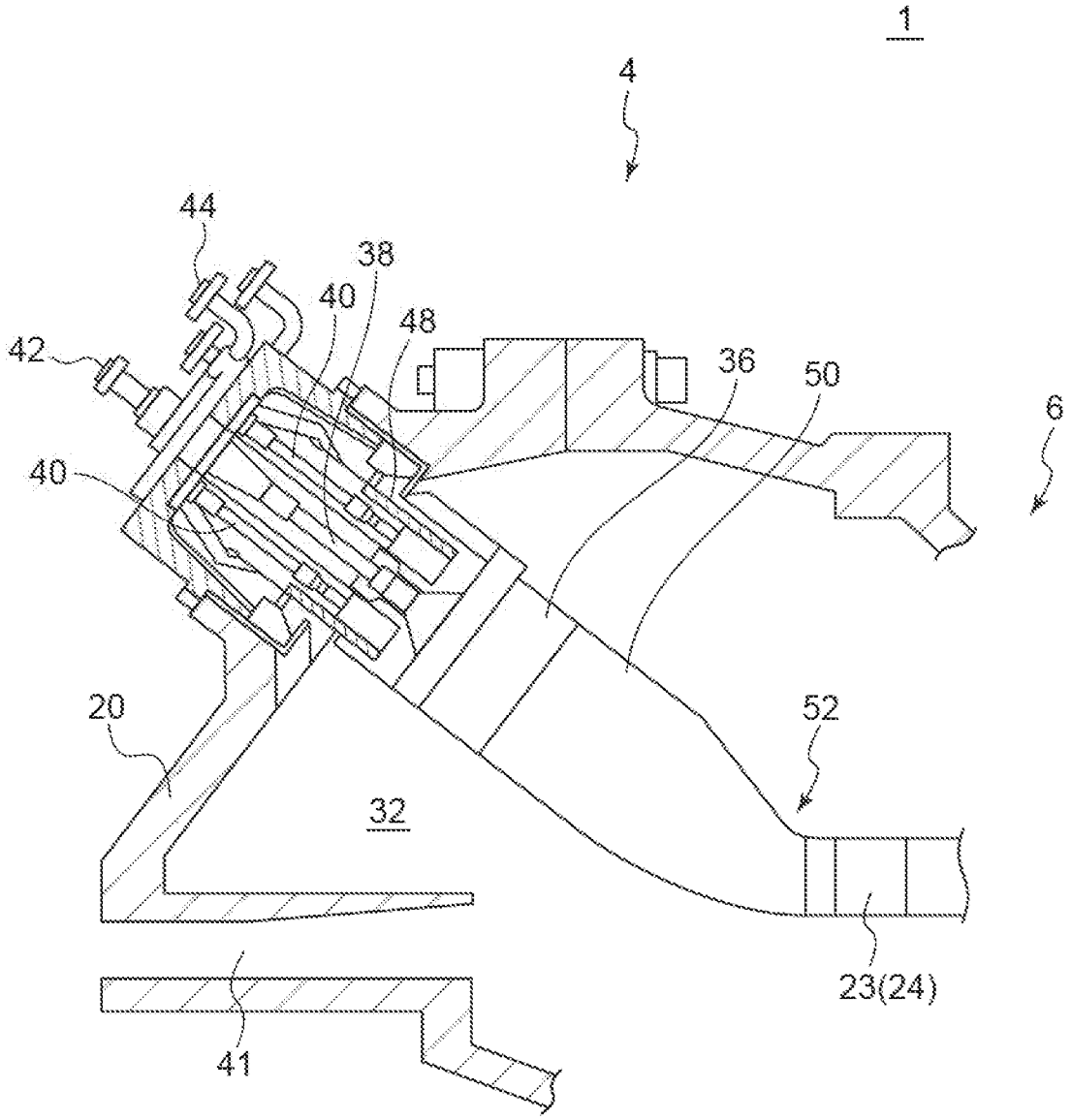
FIG. 2 is a schematic configuration diagram of a combustor 4 and an inlet portion of a turbine 6 of a gas turbine 1 according to an embodiment.

FIG. 2 is a schematic configuration diagram of a combustor 4 and an inlet portion of a turbine 6 of a gas turbine 1 according to an embodiment.

As depicted in FIG. 2, a plurality of combustors 4 are arranged in an annular shape around the rotor 8 (see FIG. 1), and each combustor 4 includes a combustor liner 36 disposed in a combustor casing 32 defined by the casing 20, a first combustion burner 38 disposed in each combustor liner 36, and a plurality of second combustion burners 40 disposed so as to surround the first combustion burner 38. The combustor 4 may include other constituent elements such as a bypass line (not depicted) for allowing the combustion gas to bypass.

The combustor liner 36 includes a combustor basket 48 disposed around the first combustion burner 38 and the plurality of second combustion burners 40, and a transition piece 50 connected to a tip portion of the combustor basket 48. The combustor basket 48 and the transition piece 50 may form an integrated combustion liner.

The first combustion burner 38 and the second combustion burner 40 each include a fuel nozzle (not depicted) for injecting fuel and a burner cylinder (not depicted) disposed so as to surround the fuel nozzle. Each fuel nozzle is supplied with fuel via each of fuel ports 42, 44. Further, compressed air produced in the compressor 2 (see FIG. 1) is supplied into the combustor casing 32 via a casing inlet 41, and flows into each of the burner cylinders from the combustor casing 32. In each burner cylinder, fuel injected from the fuel nozzle and compressed air are mixed, and the gas mixture flows into the combustor liner 36 to be ignited and combusted. Accordingly, combustion gas is produced.

Furthermore, the first combustion burner 38 may be a burner for generating diffusion combustion flame, and the second combustion burner 40 may be a burner for combusting pre-mixed gas and generating pre-mixed combustion flame. That is, in the second combustion burner 40, fuel from the fuel port 44 and compressed air are pre-mixed, and the pre-mixed air mainly forms a swirl flow with a swirler (not depicted), and flows into the combustor liner 36.

Further, the compressed air and fuel injected from the first combustion burner 38 via the fuel port 42 are mixed in the combustor liner 36, and ignited by a pilot light (not depicted) to be combusted, whereby combustion gas is generated. At this time, a part of the combustion gas diffuses away accompanied by flames, which ignites the premixed air flowing into the combustor liner 36 from each of the second combustion burners 40 to cause combustion. Specifically, the diffusion combustion flame due to the diffusion combustion fuel injected from the first combustion burner 38 can hold flames for performing stable combustion of air-fuel mixture (premixed fuel) from the second combustion burners 40. At this time, a combustion region may be formed in, for instance, the combustor basket 48, and may not necessarily be formed in the transition piece 50.

The combustion gas produced through combustion of fuel in the combustor 4 as described above flows into the first-stage stationary vane 23 of the turbine 6 via the outlet portion 52 of the combustor 4 positioned at the downstream end portion of the transition piece 50.

Figure 3:
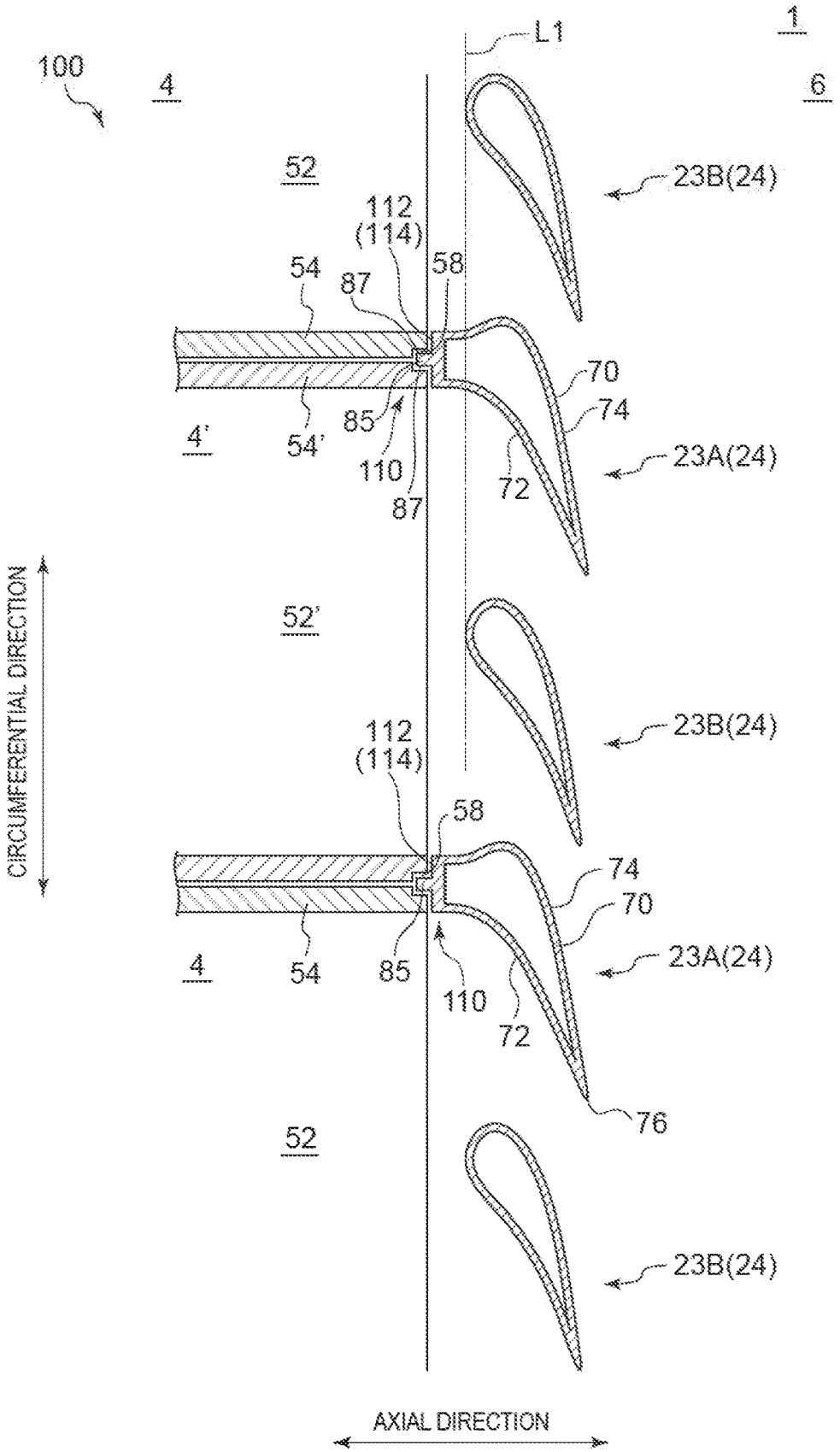
FIG. 3 is a schematic configuration diagram of an outlet portion 52 of a combustor 4 and an inlet portion of a turbine 6 of a gas turbine 1.
Figure 4:
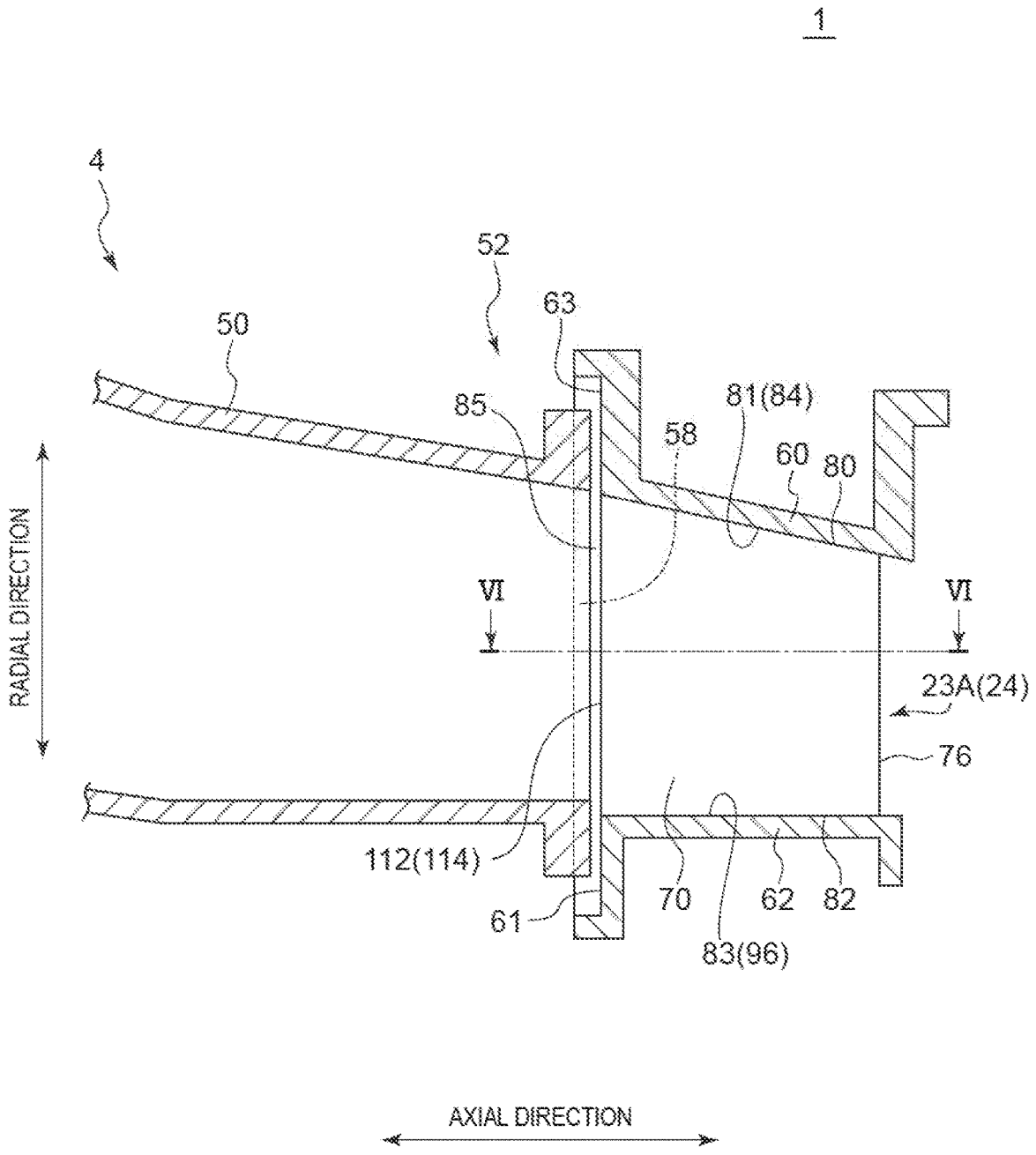
FIG. 4 is a schematic configuration diagram of an outlet portion 52 of a combustor 4 and an inlet portion of a turbine 6 of a gas turbine 1.
Figure 5:
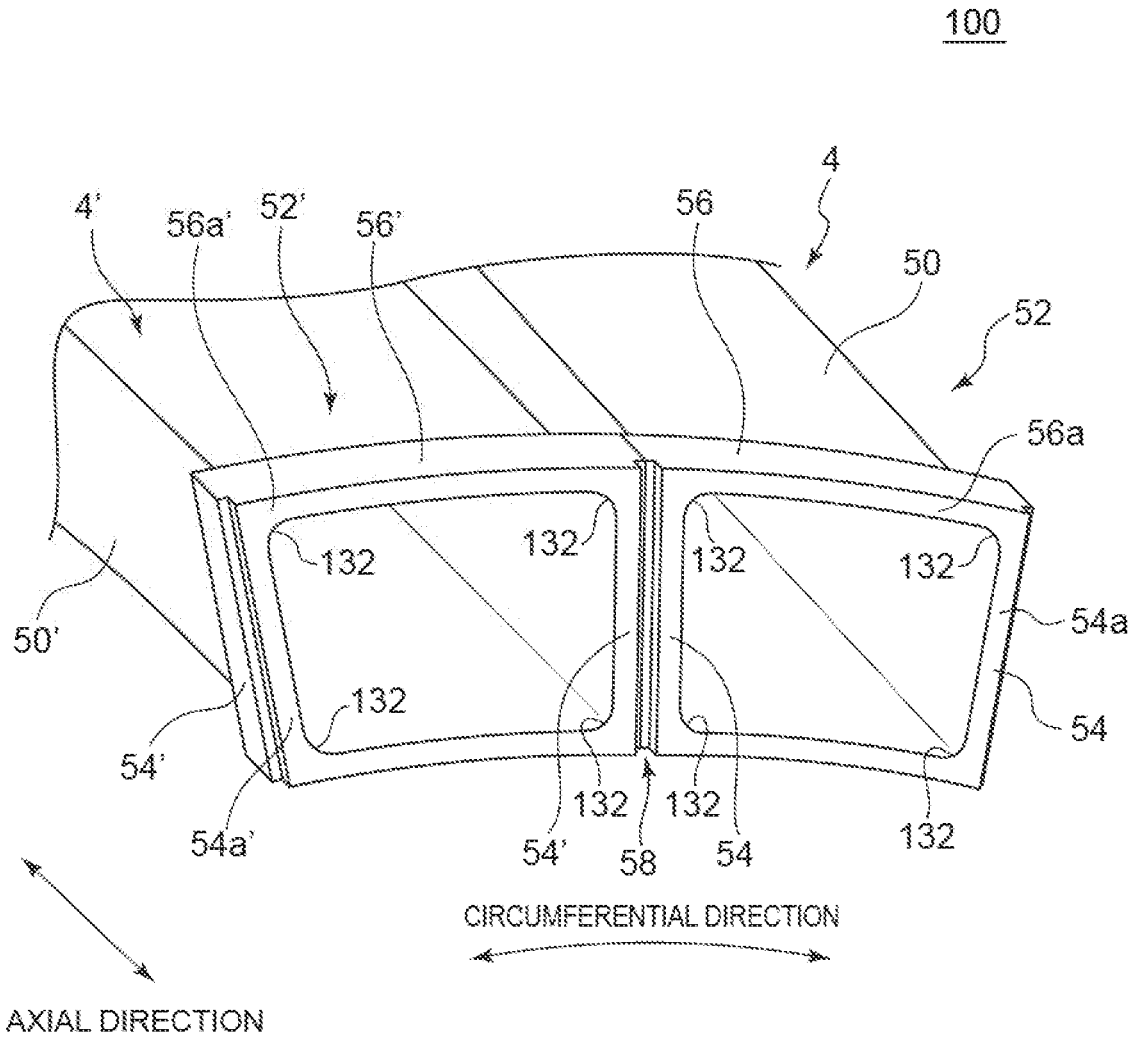
FIG. 5 is a configuration diagram of an outlet portion 52 of a combustor 4 (combustor assembly 100) according to an embodiment.
Figure 6:
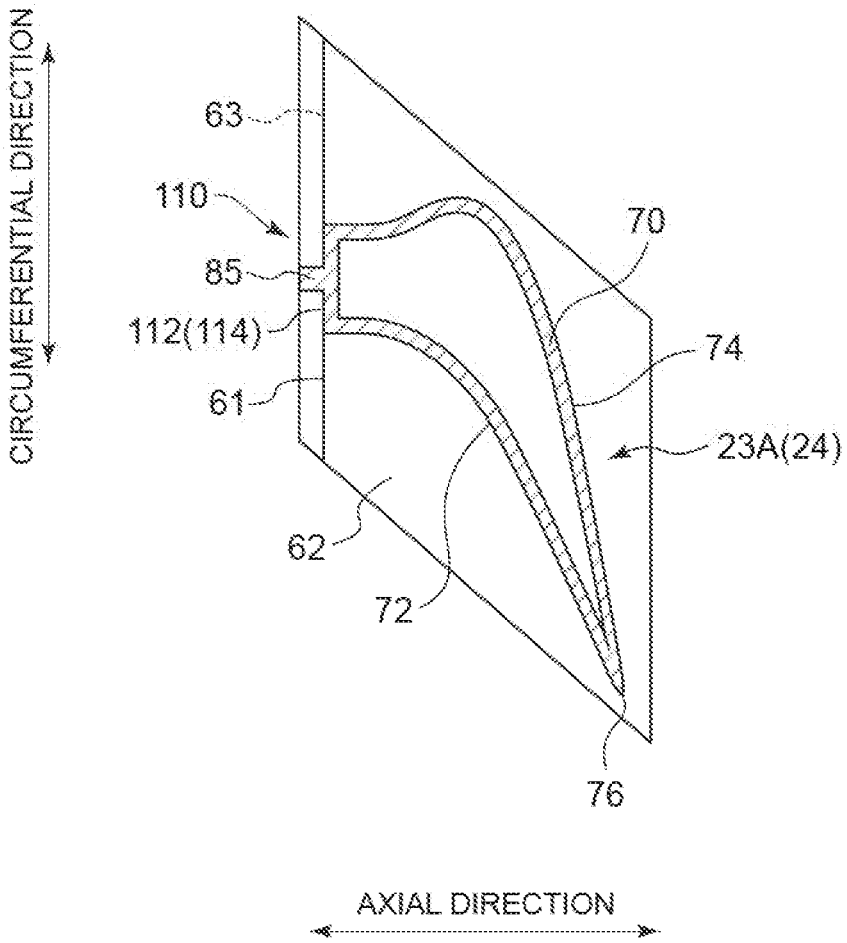
FIG. 6 is a cross-sectional view of a first-stage stationary vane 23 according to an embodiment (VI-VI cross-sectional view shown in FIG. 4).
Figure 7:
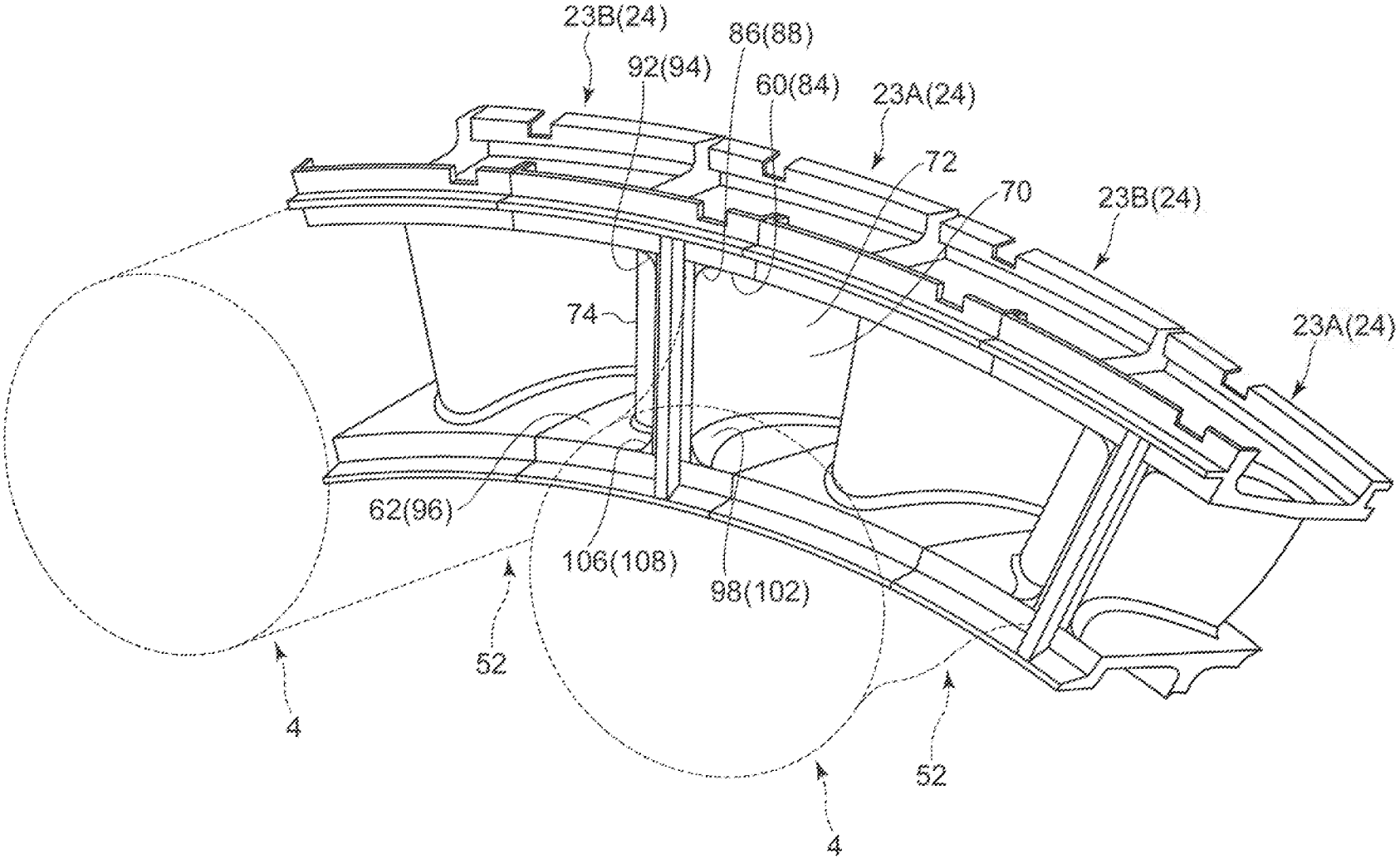
FIG. 7 is a perspective view of a plurality of first-stage stationary vanes 23 and a plurality of combustors 4 according to an embodiment.
Figure 8:
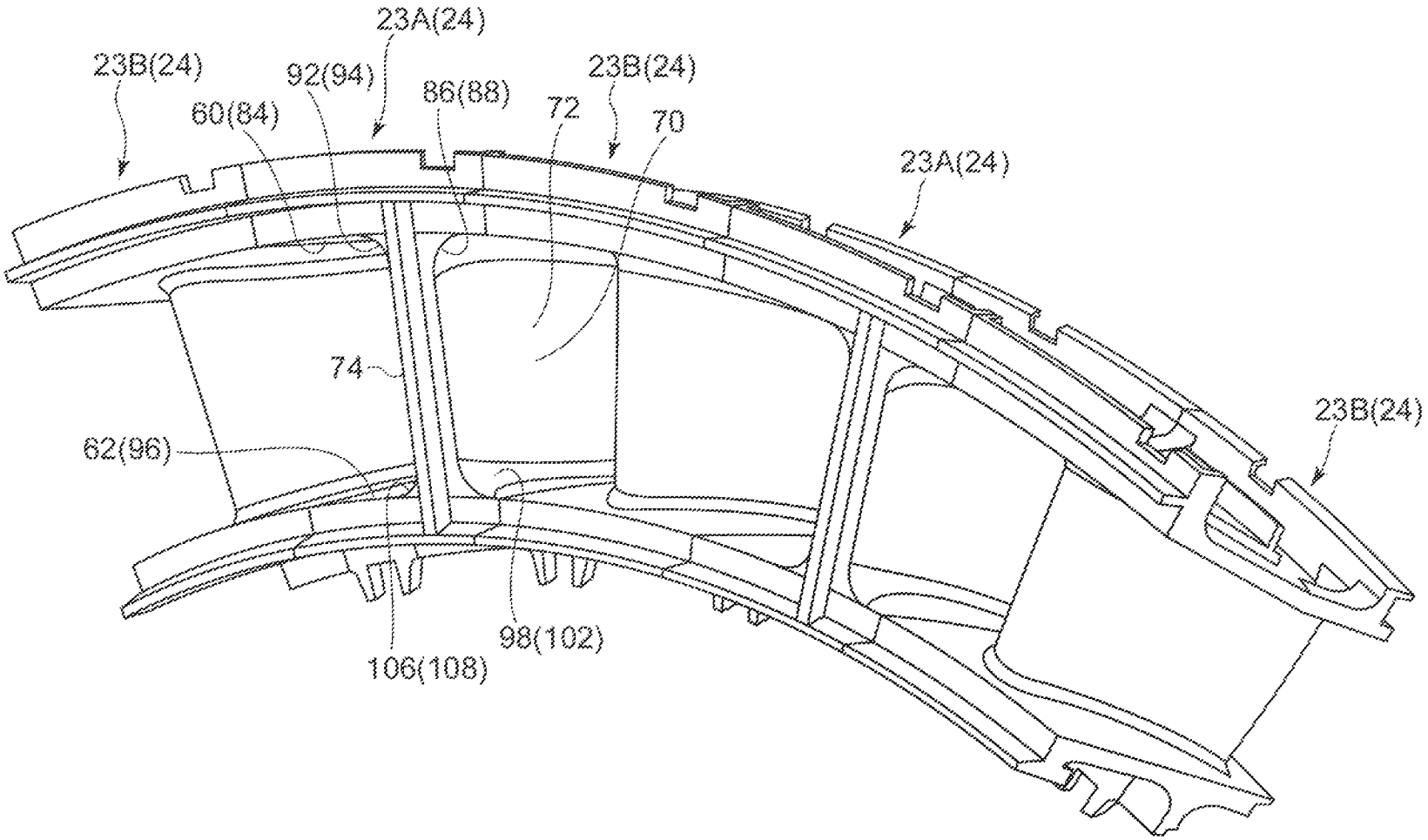
FIG. 8 is a perspective view of a plurality of first-stage stationary vanes 23 according to an embodiment.

FIGS. 3 and 4 are each a schematic configuration diagram of the outlet portion 52 of the combustor 4 and an inlet portion of the turbine 6 of the gas turbine 1. Of the drawings, FIG. 3 is a cross-sectional view taken along the circumferential direction and FIG. 4 is a cross-sectional view taken along the radial direction. FIG. 5 is a configuration diagram of the outlet portion 52 of the combustor 4 (combustor assembly 100) according to an embodiment. In FIG. 5, adjacent two combustors are depicted, from among the plurality of combustors 4 arranged in the circumferential direction. FIG. 6 is a cross-sectional view of a first-stage stationary vane 23 according to an embodiment (VI-VI cross-sectional view shown in FIG. 4). FIG. 7 is a perspective view of a plurality of first-stage stationary vanes 23 and a plurality of combustors 4 according to an embodiment. FIG. 8 is a perspective view of a plurality of stationary vanes 23 according to an embodiment.

For instance, as depicted in FIGS. 3, 4, and 7, the gas turbine 1 includes a plurality of combustors 4 arranged in the circumferential direction and a first-stage stationary vane 23 positioned downstream of the outlet portions 52 of the combustors 4. That is, the combustors 4 and the first-stage stationary vanes 23 are provided separately.

The plurality of combustors 4 arranged in the circumferential direction form a combustor assembly 100 according to some embodiments. For instance, as depicted in FIGS. 3 and 5, the plurality of combustors 4 each have an outlet portion 52 positioned on the downstream end portion of the combustor 4, and the outlet portion 52 of each combustor 4 includes radial-directional wall portions 54, 54' that extend along the radial direction and a circumferential-directional wall portion 56 that extends along the circumferential direction. Herein, of the outlet portions 52 of the combustors 4 that are adjacent to one another in the circumferential direction, the radial-directional wall portion 54 of one of the combustors 4 and the radial-directional wall portion 54' of the other one of the combustors 4 are a pair of radial-directional wall portions 54, 54' that face each other.

In some embodiments, as depicted in FIGS. 3, 7, and 8 for instance, the plurality of first-stage stationary vanes 23 arranged along the circumferential direction include a first-stage stationary vane 23A disposed downstream of the above described pair of radial-directional wall portions 54, 54'.

In some embodiments, as depicted in FIGS. 3, 7, and 8 for instance, the plurality of first-stage stationary vanes 23 further include another first-stage stationary vane 23B disposed at a circumferential-directional position between the pair of first-stage stationary vanes 23A, 23A that are adjacent in the circumferential direction. As depicted in FIG. 3, the first-stage stationary vane 23A extends further upstream from the leading edge of the first-stage stationary vane 23B. In FIG. 3, the position of the leading edge, in the axial direction, of the first-stage stationary vane 23B is indicated by a single-dot chain line L1. In the embodiment depicted in FIGS. 3, 7, and 8, the plurality of first-stage stationary vanes 23 arranged along the circumferential direction include the first-stage stationary vanes 23A and the first-stage stationary vanes 23B arranged alternately in the circumferential direction.

For instance, as depicted in at least one of FIG. 4 or 6, the first-stage stationary vane 23A includes a hollow vane portion 70 that has a pressure surface 72 and a suction surface 74, an outer shroud wall portion 60 that is disposed on the outer end portion 80 of the vane portion 70 with respect to the radial direction and forms an outer flow passage wall 81 in the radial direction, and an inner shroud wall portion 62 that is disposed on the inner end portion 82 of the vane portion 70 with respect to the radial direction and forms the inner flow passage wall 83 in the radial direction. The pressure surface 72 and the suction surface 74 are connected via a trailing edge 76. The outer shroud wall portion 60 is supported on the turbine casing 22 (see FIG. 1), and the first-stage stationary vanes 23 are supported on the turbine casing 22 via the outer shroud wall portion 60.

Figure 9:
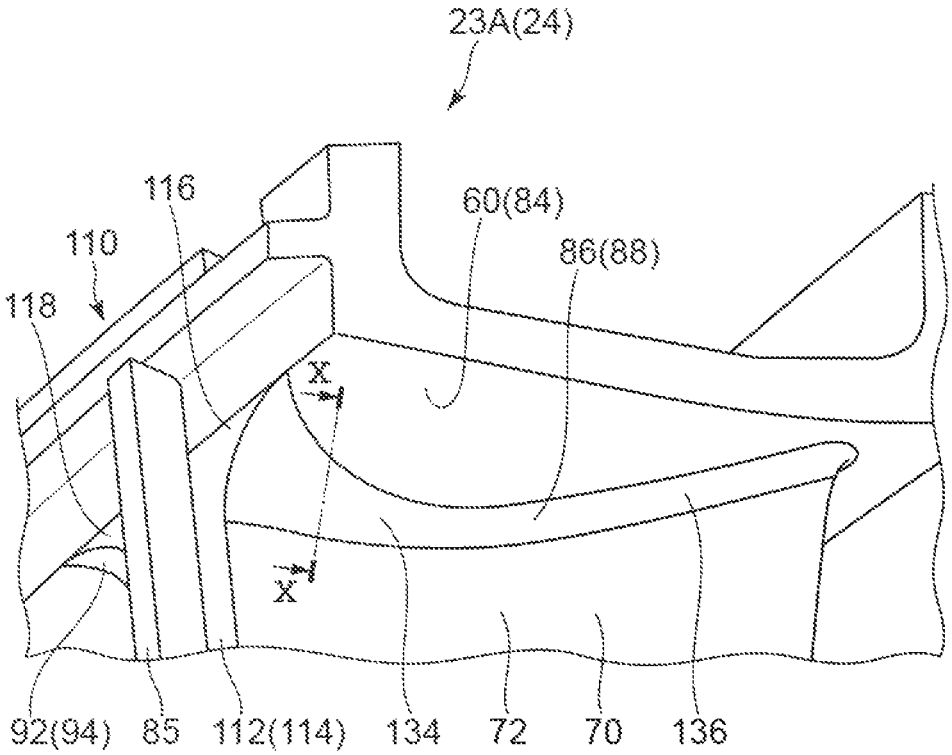
FIG. 9 is a partial perspective view of a first-stage stationary vane 23A according to an embodiment.
Figure 10:
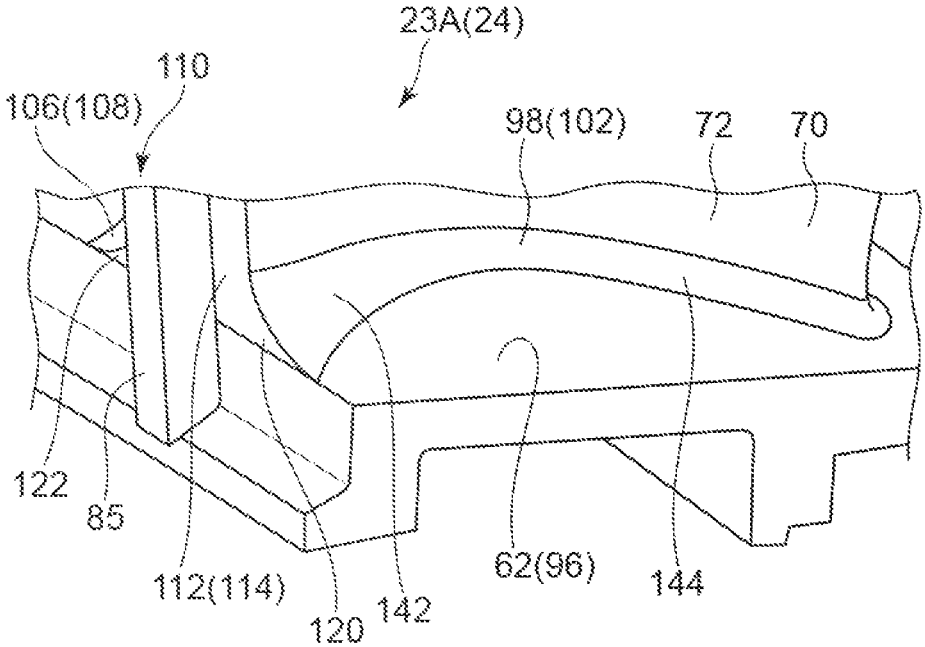
FIG. 10 is a partial perspective view of a first-stage stationary vane 23A according to an embodiment.
Figure 11:
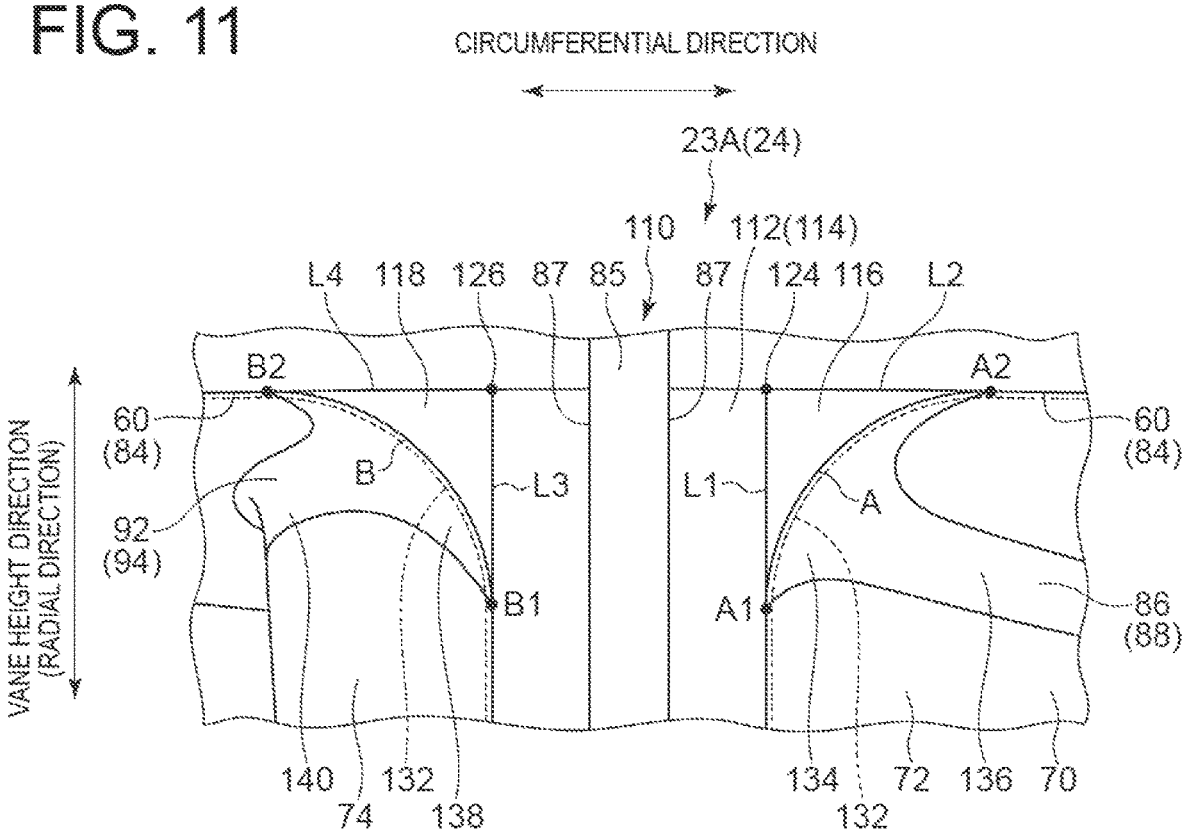
FIG. 11 is a partial view of the first-stage stationary vane 23A shown in FIG. 9, as seen from the upstream side in the axial direction.
Figure 12:
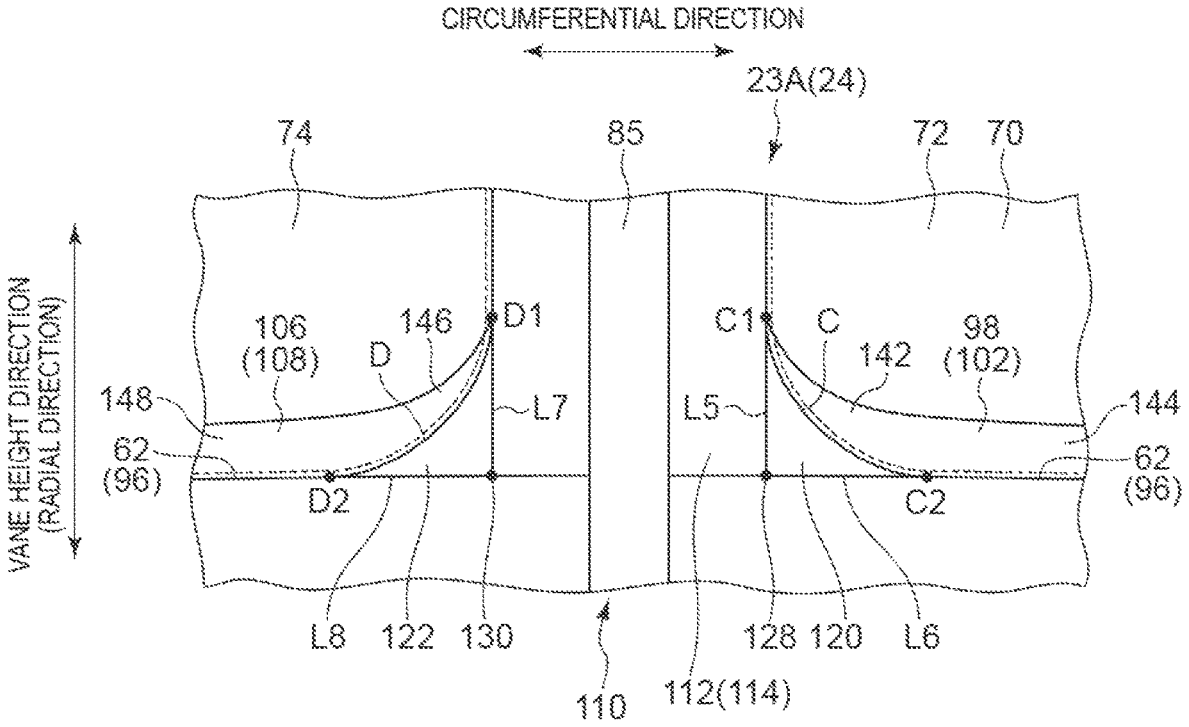
FIG. 12 is a partial view of the first-stage stationary vane 23A shown in FIG. 10, as seen from the upstream side in the axial direction.

FIG. 9 is a perspective partial view of a first-stage stationary vane 23A according to an embodiment. FIG. 10 is a perspective partial view of a first-stage stationary vane 23A according to an embodiment. FIG. 11 is a partial view of a first-stage stationary vane 23A shown in FIG. 9, as seen from the upstream side in the axial direction. FIG. 12 is a partial view of the first-stage stationary vane 23A shown in FIG. 10, as seen from the upstream side in the axial direction.

In some embodiments, as depicted in FIGS. 7 to 9 and 11 for instance, the first-stage stationary vane 23A includes a pressure-surface side fillet portion 88 disposed on a corner portion 86 formed by the pressure surface 72 and the wall surface 84 of the outer shroud wall portion 60, and a suction-surface side fillet portion 94 disposed on a corner portion 92 formed by the suction surface 74 and the wall surface 84 of the outer shroud wall portion 60. For instance, as depicted in FIGS. 9 and 11, the pressure-surface side fillet portion 88 and the suction-surface side fillet portion 94 are separated at the leading-edge side of the vane portion 70 so as not to connect to one another.

With the above configuration, the pressure-surface side fillet portion 88 and the suction-surface side fillet portion 94 are separated at the leading edge side of the vane portion 70, and thus the pressure-surface side fillet portion 88 and the suction-surface side fillet portion 94 are less likely to hinder reduction of the distance between the outlet portions 52 of the combustors 4 and the vane portion 70, compared to a case where a fillet is disposed along the entire periphery of the vane portion at the boundary to the shroud wall portion as described in Patent Document 1. Thus, it is possible to block acoustic transmission between the outlet portions 52 of the plurality of combustors 4 by reducing the distance between the outlet portions 52 of the combustors 4 and the vane portion 70, and reduce combustion vibration effectively.

In some embodiments, as depicted in FIGS. 7, 8, 10, and 12 for instance, the first-stage stationary vane 23A includes a pressure-surface side fillet portion 102 disposed on a corner portion 98 formed by the pressure surface 72 and the wall surface 96 of the inner shroud wall portion 62, and a suction-surface side fillet portion 108 disposed on a corner portion 106 formed by the suction surface 74 and the wall surface 96 of the inner shroud wall portion 62. For instance, as depicted in FIGS. 9 and 11, the pressure-surface side fillet portion 102 and the suction-surface side fillet portion 108 are separated at the leading-edge side of the vane portion 70 so as not to connect to one another.

With the above configuration, the pressure-surface side fillet portion 102 and the suction-surface side fillet portion 108 are separated at the leading edge side of the vane portion 70, and thus the pressure-surface side fillet portion 102 and the suction-surface side fillet portion 108 are less likely to hinder reduction of the distance between the outlet portions 52 of the combustors 4 and the vane portion 70, compared to a case where a fillet is disposed along the entire periphery of the vane portion at the boundary to the shroud wall portion as described in Patent Document 1. Thus, it is possible to block acoustic transmission between the outlet portions 52 of the plurality of combustors 4 by reducing the distance between the outlet portions 52 of the combustors 4 and the vane portion 70, and reduce combustion vibration effectively.

In some embodiments, as depicted in FIGS. 3, 6, and 9 to 12 for instance, the upstream-side end portion 110 of the vane portion 70 in the axial direction includes an upstream-side end surface 112 that connects the pressure surface 72 and the suction surface 74, and the upstream-side end surface 112 includes a flat surface 114 that connects to each of the upstream-side end surface 63 of the outer shroud wall portion 60 and the upstream-side end surface 61 of the inner shroud wall portion 62.

With the above configuration, by arranging the flat surface 114 so as to be proximately facing the radial-directional wall portions 54, 54' of the outlet portions 52 of the combustors 4 as depicted in FIG. 3 for instance, it is possible to reduce the gap between the flat surface 114 and the radial-directional wall portions 54, 54' over a broad range in the circumferential direction. Accordingly, it is possible to block acoustic transmission between the outlet portions 52 of the plurality of combustors 4, and reduce combustion vibration effectively.

In some embodiments, as depicted in FIGS. 9 to 12 for instance, the upstream-side end portion 110 includes a protruding portion 85 that protrudes toward the upstream side from the flat surface 114. In the depicted embodiment, the protruding portion 85 extends along the radial direction, and connects to the outer shroud wall portion 60 and the inner shroud wall portion 62. Further, as depicted in FIGS. 3 and 4 for instance, the downstream-side ends 54*a*, 54*a*' of at least one of the pair of radial-directional wall portions 54, 54' have a protruding-portion receiving space 58 to be engaged with the protruding portion 85. The protruding-portion receiving space 58 may be a groove formed so as to extend along the radial direction, for instance.

Further, as depicted in FIG. 3 for instance, the pair of radial-directional wall portions 54, 54' of the combustors 4 overlaps with the protruding portion 85 of the first-stage stationary vane 23A in the axial direction. Thus, even if the first-stage stationary vane 23A is relatively displaced mainly in the axial direction with respect to the combustors 4 due to thermal transformation during operation of the gas turbine 1, it is possible to suppress an increase of the gap, in the circumferential direction, between the pair of side wall surfaces 87 of the protruding portion 85 of the first-stage stationary vane 23A (see FIGS. 3 and 11, for instance) and the radial-directional wall portions 54, 54' through which the outlet portions 52 of adjacent combustors 4 are in communication, and block acoustic transmission between the outlet portions 52 of the plurality of combustors 4. In this way, it is possible to reduce combustion vibration due to acoustic transmission between the outlet portions 52 of the plurality of combustors 4.

In some embodiments, as depicted in FIG. 9 for instance, the upstream-side end surface 116 of the pressure-surface side fillet portion 88 and the upstream-side end surface 118 of the suction-surface side fillet portion 94 are formed so as not to protrude upstream from the flat surface 114.

With the above configuration, the pressure-surface side fillet portion 88 and the suction-surface side fillet portion 94 are less likely to hinder reduction of the distance between the outlet portions 52 of the combustors 4 and the vane portion 70 at the leading edge side of the vane portion 70, compared to a case where the upstream-side end surface 116 of the pressure-surface side fillet portion 88 and the upstream-side end surface 118 of the suction-surface side fillet portion 94 protrude upstream from the flat surface 114. Thus, it is possible to block acoustic transmission between the outlet portions 52 of the plurality of combustors 4 by reducing the distance between the outlet portions 52 of the combustors 4 and the vane portion 70, and reduce combustion vibration effectively.

In some embodiments, as depicted in FIG. 10 for instance, the upstream-side end surface 120 of the pressure-surface side fillet portion 102 and the upstream-side end surface 122 of the suction-surface side fillet portion 108 are formed so as not to protrude upstream from the flat surface 114.

With the above configuration, the pressure-surface side fillet portion 102 and the suction-surface side fillet portion 108 are less likely to hinder reduction of the distance between the outlet portions 52 of the combustors 4 and the vane portion 70 at the leading edge side of the vane portion 70, compared to a case where the upstream-side end surface 120 of the pressure-surface side fillet portion 102 and the upstream-side end surface 122 of the suction-surface side fillet portion 108 protrude upstream from the flat surface 114. Thus, it is possible to block acoustic transmission between the outlet portions 52 of the plurality of combustors 4 by reducing the distance between the outlet portions 52 of the combustors 4 and the vane portion 70, and reduce combustion vibration effectively.

In some embodiments, as depicted in FIG. 11 for instance, the upstream-side end surface 116 of the pressure-surface side fillet portion 88 is defined by a curve A that smoothly connects the pressure surface 72 and the wall surface 84 of the outer shroud wall portion 60, a segment L1 that extends from an end A1 of the curve A to the wall surface 84 of the outer shroud wall portion 60 along the vane height direction, and a segment L2 that extends to the other end A2 of the curve A from the joint portion 124 between the segment L1 and the wall surface 84 of the outer shroud wall portion 60.

For instance, as depicted in FIG. 5, at the outlet portion 52 of each combustor 4, the corner portion 132 of each of the radial-directional wall portion 54 and the circumferential-directional wall portion 56 has a round shape. Thus, as depicted in FIG. 11, with the upstream-side end surface 116 of the pressure-surface side fillet portion 88 having a shape defined by the curve A, the segment L1, and the segment L2, when the upstream-side end surface 116 of the pressure-surface side fillet portion 88 faces one of the corner portions 132 of the outlet portions 52 of the combustors 4, it is possible to eliminate, or reduce, the step between the curve A of the pressure-surface side fillet portion 88 and the corner portion 132 of the outlet portion 52 of the combustor 4 as depicted in FIG. 11. Accordingly, it is possible to suppress separation of flow due to the step, and suppress efficiency deterioration of the gas turbine 1.

In some embodiments, as depicted in FIG. 11 for instance, the upstream-side end surface 118 of the suction-surface side fillet portion 94 is defined by a curve B that smoothly connects the suction surface 74 and the wall surface 84 of the outer shroud wall portion 60, a segment L3 that extends from an end B1 of the curve B to the wall surface 84 of the outer shroud wall portion 60 along the vane height direction, and a segment L4 that extends to the other end B2 of the curve B from the joint portion 126 between the segment L3 and the wall surface 84 of the outer shroud wall portion 60.

Thus, with the upstream-side end surface 118 of the suction-surface side fillet portion 94 having a shape defined by the curve B, the segment L3, and the segment L4 as described above, when the upstream-side end surface 118 of the suction-surface side fillet portion 94 faces one of the corner portions 132 of the outlet portions 52 of the combustors 4, it is possible to eliminate, or reduce, the step between the curve B of the suction-surface side fillet portion 94 and the corner portion 132 of the outlet portion 52 of the combustor 4. Accordingly, it is possible to suppress separation of flow due to the step, and suppress efficiency deterioration of the gas turbine 1.

In some embodiments, as depicted in FIG. 12 for instance, the upstream-side end surface 120 of the pressure-surface side fillet portion 102 is defined by a curve C that smoothly connects the pressure surface 72 and the wall surface 96 of the inner shroud wall portion 62, a segment L5 that extends from an end C1 of the curve C to the wall surface 96 of the inner shroud wall portion 62 along the vane height direction, and a segment L6 that extends to the other end C2 of the curve C from the joint portion 128 between the segment L5 and the wall surface 96 of the inner shroud wall portion 62.

Thus, with the upstream-side end surface 120 of the pressure-surface side fillet portion 102 having a shape defined by the curve C, the segment L5, and the segment L6 as described above, when the upstream-side end surface 120 of the pressure-surface side fillet portion 102 faces one of the corner portions 132 of the outlet portions 52 of the combustors 4, it is possible to eliminate, or reduce, the step between the curve C of the pressure-surface side fillet portion 102 and the corner portion 132 of the outlet portion 52 of the combustor 4 as depicted in FIG. 11. Accordingly, it is possible to suppress separation of flow due to the step, and suppress efficiency deterioration of the gas turbine 1.

In some embodiments, as depicted in FIG. 12 for instance, the upstream-side end surface 122 of the suction-surface side fillet portion 108 is defined by a curve D that smoothly connects the suction surface 74 and the wall surface 96 of the inner shroud wall portion 62, a segment L7 that extends from an end D1 of the curve D to the wall surface 96 of the inner shroud wall portion 62 along the vane height direction, and a segment L8 that extends to the other end D2 of the curve D from the joint portion 130 between the segment L7 and the wall surface 96 of the inner shroud wall portion 62.

Thus, with the upstream-side end surface 122 of the suction-surface side fillet portion 108 having a shape defined by the curve D, the segment L7, and the segment L8 as described above, when the upstream-side end surface 122 of the suction-surface side fillet portion 108 faces one of the corner portions 132 of the outlet portions 52 of the combustors 4, it is possible to eliminate, or reduce, the step between the curve D of the suction-surface side fillet portion 108 and the corner portion 132 of the outlet portion 52 of the combustor 4 as depicted in FIG. 11. Accordingly, it is possible to suppress separation of flow due to the step, and suppress efficiency deterioration of the gas turbine 1.

In some embodiments, as depicted in FIGS. 9 and 11, the pressure-surface side fillet portion 88 includes a fillet radius increasing portion 134 whose fillet radius increases toward the upstream side. In the depicted embodiment, the pressure-surface side fillet portion 88 includes, on the downstream side of the fillet radius increasing portion 134, a fillet radius constant portion 136 whose fillet radius is constant in the axial direction.

At the outlet portions of the combustors of a typical gas turbine, as described above, the corner portion of each of the radial-directional wall portion and the circumferential-directional wall portion has a round shape. Further, the fillet radius of the pressure-surface side fillet portion of a typical stationary vane is smaller than the curvature radius of the corner portion of the outlet portion of each combustor.

Thus, if the first-stage stationary vane is disposed proximate to the outlet portions of the combustors of a typical gas turbine without any measure, a step is formed between the pressure-surface side fillet portion and the corner portions of the outlet portions of the combustors, and the step causes separation of flow, which leads to efficiency deterioration of the gas turbine.

In contrast, in the above first-stage stationary vane 23A, the pressure-surface side fillet portion 88 includes the fillet radius increasing portion 134 where the fillet radius increases toward the upstream side, and thus it is possible to eliminate or reduce the above step. Accordingly, it is possible to suppress separation of flow due to the step, and suppress efficiency deterioration of the gas turbine 1.

Further, if a stationary vane does not include a fillet radius increasing portion and has a relatively small fillet radius, thermal stress is likely to concentrate on the fillet portion. In contrast, the first-stage stationary vane 23A with the fillet radius increasing portion 134 has a large fillet radius at the leading-edge side, and thus it is possible to mitigate concentration of thermal stress at the fillet portion and reduce the peak value of thermal stress.

In some embodiments, as depicted in FIG. 11, the suction-surface side fillet portion 94 includes a fillet radius increasing portion 138 whose fillet radius increases toward the upstream side. In the depicted embodiment, the suction-surface side fillet portion 94 includes a fillet radius constant portion 140 whose fillet radius is constant in the axial direction, on the downstream side of the fillet radius increasing portion 138.

At the outlet portions of the combustors of a typical gas turbine, as described above, the corner portion of each of the radial-directional wall portion and the circumferential-directional wall portion has a round shape. Further, the fillet radius of the suction-surface side fillet portion of a typical stationary vane is smaller than the curvature radius of the corner portion of the outlet portion of each combustor.

Thus, when the first-stage stationary vane is disposed proximate to the outlet portions of the combustors of a typical gas turbine without any measure, a step is formed between the suction-surface side fillet portion and the corner portions of the outlet portions of the combustors, and the step causes separation of flow, which leads to deterioration of efficiency of the gas turbine.

In contrast, in the above first-stage stationary vane 23A, the suction-surface side fillet portion 94 includes the fillet radius increasing portion 138 where the fillet radius increases toward the upstream side, and thus it is possible to eliminate or reduce the above step. Accordingly, it is possible to suppress separation of flow due to the step, and suppress efficiency deterioration of the gas turbine 1. Further, it is possible to mitigate concentration of thermal stress at the fillet portion and reduce the peak value of thermal stress.

In some embodiments, as depicted in FIG. 10, the pressure-surface side fillet portion 102 includes a fillet radius increasing portion 142 where the fillet radius increases toward the upstream side. In the depicted embodiment, the pressure-surface side fillet portion 102 includes a fillet radius constant portion 144 where the fillet radius is constant in the axial direction, on the downstream side of the fillet radius increasing portion 142.

With the above configuration, it is possible to eliminate or reduce the step between the pressure-surface side fillet portion 102 and the corner portions 132 of the outlet portions 52 of the combustors 4. Accordingly, it is possible to suppress separation of flow due to the step, and suppress efficiency deterioration of the gas turbine 1. Further, it is possible to mitigate concentration of thermal stress at the fillet portion and reduce the peak value of thermal stress.

In some embodiments, as depicted in FIG. 12 for instance, the suction-surface side fillet portion 108 includes a fillet radius increasing portion 146 where the fillet radius increases toward the upstream side. In the depicted embodiment, the suction-surface side fillet portion 108 includes a fillet radius constant portion 148 where the fillet radius is constant regardless of the flow direction position, on the downstream side of the fillet radius increasing portion 146.

With the above configuration, it is possible to eliminate or reduce the step between the suction-surface side fillet portion 108 and the corner portions 132 of the outlet portions 52 of the combustors 4. Accordingly, it is possible to suppress separation of flow due to the step, and suppress efficiency deterioration of the gas turbine 1. Further, it is possible to mitigate concentration of thermal stress at the fillet portion and reduce the peak value of thermal stress.

Figure 13:
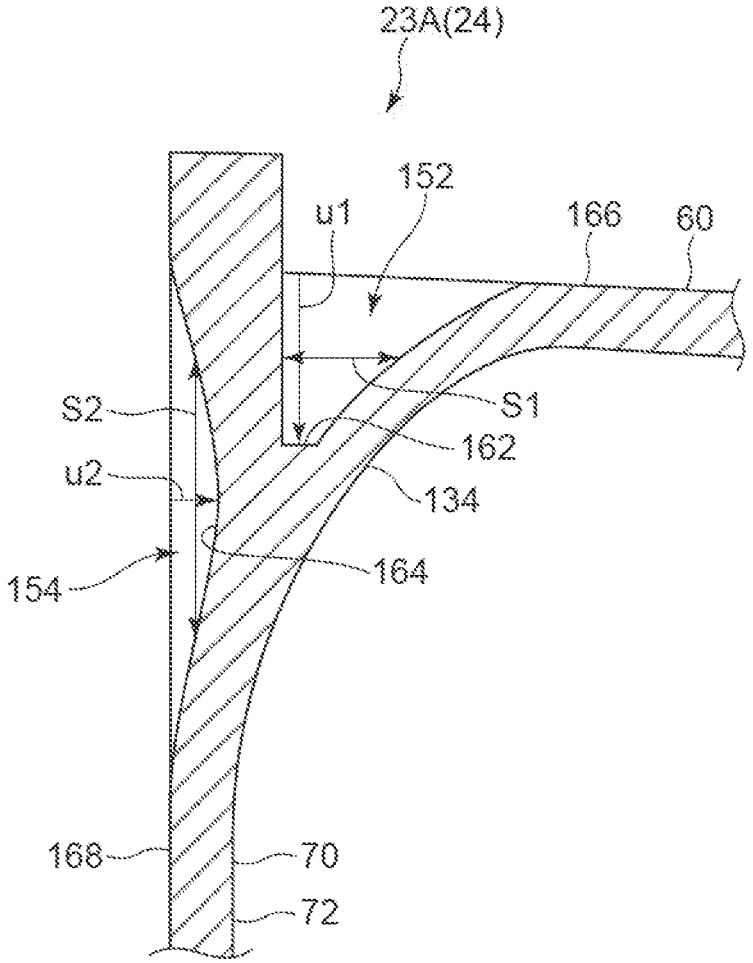
FIG. 13 is a X-X cross-sectional view of FIG. 9.

FIG. 13 is a X-X cross-sectional view of FIG. 9.

In some embodiments, as depicted in FIG. 13, the wall surface 166 on the radially outer side of the outer shroud wall portion 60 includes a cut-out portion 152 that is recessed toward the fillet radius increasing portion 134 from the back side of the fillet radius increasing portion 134. In the illustrative embodiment, the cut-out portion 152 has a depth that reduces the thickness of the fillet radius increasing portion 134.

In a case where the fillet radius is increased by providing the fillet radius increasing portion 134 as described above without any measure, the metal temperature of the thick portion of the fillet radius increasing portion 134 increases, and the thick portion pushes the fillet portion and generates a high stress.

In contrast, by providing the cut-out portion 152, it is possible to reduce the metal temperature of the thick portion of the fillet radius increasing portion 134, and reduce stress that is generated at the fillet portion.

In some embodiments, as depicted in FIG. 13, the inner peripheral surface 168 of the vane portion 70 includes a cut-out portion 154 that is recessed toward the fillet radius increasing portion 134 from the back side of the fillet radius increasing portion 134.

Accordingly, compared to a case where the cut-out portion 154 is not provided, it is possible to reduce the metal temperature of the thick portion of the fillet radius increasing portion 134, and reduce stress that is generated at the fillet portion.

In some embodiments, as depicted in FIG. 13 for instance, the cross-sectional area S1 that is orthogonal to the depth direction u1 of the cut-out portion 152 decreases toward the bottom portion 162 of the cut-out portion 152 in the depth direction u1.

Accordingly, the fillet radius increasing portion 134 has a more constant thickness, whereby it is possible to effectively reduce the metal temperature of the thick portion of the fillet radius increasing portion 134, and effectively reduce stress that is generated at the fillet portion.

In some embodiments, as depicted in FIG. 13 for instance, the cross-sectional area S2 that is orthogonal to the depth direction u2 of the cut-out portion 154 decreases toward the bottom portion 164 of the cut-out portion 154 in the depth direction u2.

Accordingly, the fillet radius increasing portion 134 has a more constant thickness, whereby it is possible to effectively reduce the metal temperature of the thick portion of the fillet radius increasing portion 134, and effectively reduce stress that is generated at the fillet portion.

Figure 14:
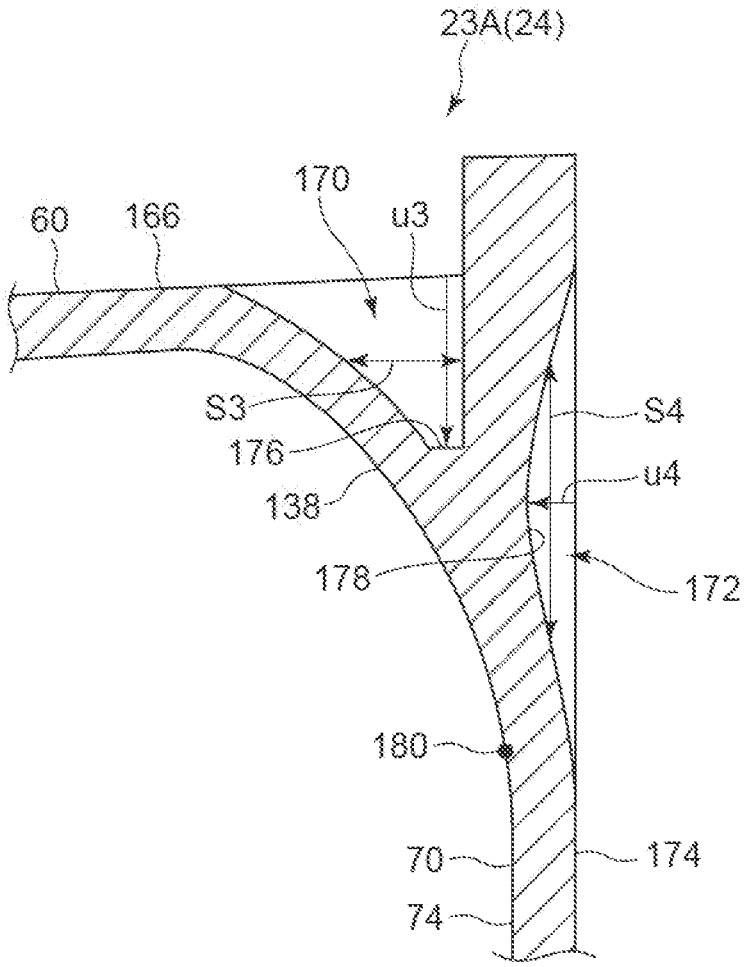
FIG. 14 is a cross-sectional view of a configuration example of cut-out portions 170, 172 disposed at the side of the suction surface 74 of the first-stage stationary vane 23A.

FIG. 14 is a cross-sectional view of a configuration example of cut-out portions 170, 172 disposed at the side of the suction surface 74 of the first-stage stationary vane 23A.

In some embodiments, as depicted in FIG. 14 for instance, the wall surface 166 on the radially outer side of the outer shroud wall portion 60 includes a cut-out portion 170 that is recessed toward the fillet radius increasing portion 138 from the back side of the fillet radius increasing portion 138. In the depicted embodiment, the cut-out portion 170 has a depth that reduces the thickness of the fillet radius increasing portion 138.

With the above configuration, by providing the cut-out portion 170, it is possible to reduce the metal temperature of the thick portion of the fillet radius increasing portion 138, and reduce stress that is generated at the fillet portion.

In some embodiments, as depicted in FIG. 14 for instance, the inner peripheral surface 174 of the vane portion 70 includes a cut-out portion 172 that is recessed toward the fillet radius increasing portion 138 from the back side of the fillet radius increasing portion 138.

With the above configuration, by providing the cut-out portion 172, it is possible to reduce the metal temperature of the thick portion of the fillet radius increasing portion 138, and reduce stress that is generated at the fillet portion.

In some embodiments, as depicted in FIG. 14 for instance, the cross-sectional area S3 that is orthogonal to the depth direction u3 at the cut-out portion 170 decreases toward the bottom portion 176 of the cut-out portion 170 in the depth direction u3.

Accordingly, the fillet radius increasing portion 138 has a more constant thickness, whereby it is possible to effectively reduce the metal temperature of the thick portion of the fillet radius increasing portion 138, and effectively reduce stress that is generated at the fillet portion.

In some embodiments, as depicted in FIG. 14 for instance, the cross-sectional area S4 that is orthogonal to the depth direction u4 at the cut-out portion 172 decreases toward the bottom portion 178 of the cut-out portion 172 in the depth direction u4.

Accordingly, the fillet radius increasing portion 138 has a more constant thickness, whereby it is possible to effectively reduce the metal temperature of the thick portion of the fillet radius increasing portion 138, and effectively reduce stress that is generated at the fillet portion.

Figure 15:
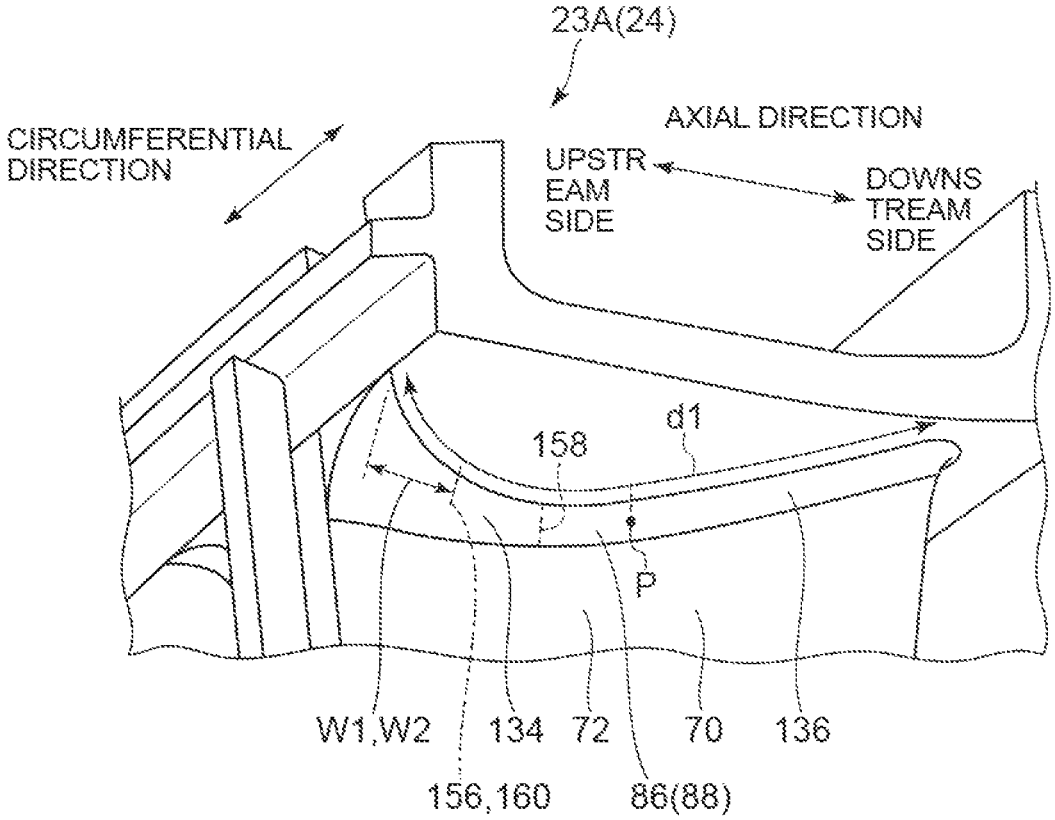
FIG. 15 is a view showing the axial-directional range W1 where a cut-out portion 152 is disposed and the axial-directional range W2 where a cut-out portion 154 is disposed.

FIG. 15 is a view showing the axial-directional range W1 where a cut-out portion 152 is disposed and the axial-directional range W2 where a cut-out portion 154 is disposed.

In some embodiments, as depicted in FIG. 15 for instance, in the axial direction, the downstream end 156 of the cut-out portion 152 is positioned upstream of the downstream end 158 of the fillet radius increasing portion 134.

If the cut-out portion 152 extends downstream of the downstream end 158 of the fillet radius increasing portion 134, the thickness of the pressure-surface side fillet portion 88 becomes too thin at the downstream side of the downstream end 158 of the fillet radius increasing portion 134, which may lead to excessive deterioration of the strength of the pressure-surface side fillet portion 88.

In contrast, with the downstream end 156 of the cut-out portion 152 being positioned upstream of the downstream end 158 of the fillet radius increasing portion 134, it is possible to suppress strength deterioration of the pressure-surface side fillet portion 88 at the downstream side of the fillet radius increasing portion 134 while reducing the metal temperature of the thick portion of the fillet radius increasing portion 134 and reducing the stress generated at the fillet portion.

In some embodiments, as depicted in FIG. 15 for instance, in the axial direction, the downstream end 160 of the cut-out portion 154 is positioned upstream of the downstream end 158 of the fillet radius increasing portion 134.

Accordingly, with the downstream end 160 of the cut-out portion 154 being positioned upstream of the downstream end 158 of the fillet radius increasing portion 134, it is possible to suppress strength deterioration of the pressure-surface side fillet portion 88 at the downstream side of the fillet radius increasing portion 134 while reducing the metal temperature of the thick portion of the fillet radius increasing portion 134 and reducing the stress generated at the fillet portion.

It should be noted that, while the position of the downstream end 156 of the cut-out portion 152 matches the position of the downstream end 160 of the cut-out portion 154 in the axial direction in the embodiment depicted in FIG. 15, these positions may be different.

In some embodiments, as depicted in FIG. 15 for instance, when P is the center position of the pressure-surface side fillet portion 88 in the extension direction dl of the pressure-surface side fillet portion 88, the downstream end 156 of the cut-out portion 152 is disposed upstream of the center position P of the pressure-surface side fillet portion 88, in the axial direction.

Accordingly, it is possible to suppress strength deterioration of the pressure-surface side fillet portion 88 at the downstream side of the center position P of the pressure-surface side fillet portion 88 while reducing the metal temperature of the thick portion of the fillet radius increasing portion 134 and reducing the stress generated at the fillet portion.

In some embodiments, as depicted in FIG. 15 for instance, in the axial direction, the downstream end 160 of the cut-out portion 154 is positioned upstream of the center position P of the pressure-surface side fillet portion 88.

Accordingly, it is possible to suppress strength deterioration of the pressure-surface side fillet portion 88 at the downstream side of the center position P of the pressure-surface side fillet portion 88 while reducing the metal temperature of the thick portion of the fillet radius increasing portion 134 and reducing the stress generated at the fillet portion.

Embodiments of the present invention were described in detail above, but the present invention is not limited thereto, and various amendments and modifications may be implemented.

For instance, in the above described embodiment, at both of the outer shroud wall portion and the inner shroud wall portion, the pressure-surface side fillet portion and the suction-surface side fillet portion are separate at the leading-edge side of the vane portion so as not to connect to each other. However, to block acoustic transmission between the outlet portions of the plurality of combustors by reducing the distance between the outlet portions of the combustors and the vane portion, it is sufficient if the pressure-surface side fillet portion and the suction-surface side fillet portion are separate at the leading edge side of the vane portion so as not to connect to one another at at least one of the outer shroud wall portion or the inner shroud wall portion.

Furthermore, in the above embodiment, at both of the outer shroud wall portion side and the inner shroud wall portion side, each of the pressure-surface side fillet portion and the suction-surface side fillet portion has a fillet radius increasing portion whose fillet radius increases toward the upstream side. However, to suppress separation of flow due to the above described gap at least partially, it is sufficient if at least one of the pressure-surface side fillet portion or the suction-surface side fillet portion has a fillet radius increasing portion whose fillet radius increases toward the upstream side at at least one of the outer shroud wall portion side or the inner shroud wall portion side.

Furthermore, in the above described embodiments, each of the outer shroud wall portion and the vane portion has a cut-out portion recessed toward the fillet radius increasing portion of the pressure-surface side fillet portion from the back side of the fillet radius increasing portion, but in other embodiments, at least one of the outer shroud wall portion or the vane portion may include a cut-out portion that is recessed toward the fillet radius increasing portion of the pressure-surface side fillet portion from the back side of the fillet radius increasing portion. Furthermore, in other embodiments, at least one of the inner shroud wall portion or the vane portion may have a cut-out portion recessed toward the fillet radius increasing portion of the pressure-surface side fillet portion from the back side of the fillet radius increasing portion Furthermore, in the above described embodiments, each of the outer shroud wall portion and the vane portion has a cut-out portion recessed toward the fillet radius increasing portion of the suction-surface side fillet portion from the back side of the fillet radius increasing portion, but in other embodiments, at least one of the outer shroud wall portion or the vane portion may include a cut-out portion that is recessed toward the fillet radius increasing portion of the suction-surface side fillet portion from the back side of the fillet radius increasing portion. Furthermore, in other embodiments, at least one of the inner shroud wall portion or the vane portion may have a cut-out portion recessed toward the fillet radius increasing portion of the suction-surface side fillet portion from the back side of the fillet radius increasing portion.

The invention claimed is:

1. A first-stage stationary vane of a gas turbine, the first-stage stationary vane being located downstream of a plurality of combustors each of which has an outlet portion including a radial-directional wall portion along a radial direction of a rotor, the plurality of combustors being disposed in a circumferential direction of the rotor, comprising:

a vane portion including a pressure surface and a suction surface;

a shroud wall portion which connects to an end portion of the vane portion and which forms a flow passage wall;

a pressure-surface side fillet portion disposed on a corner portion formed by the pressure surface and a wall surface of the shroud wall portion; and a suction-surface side fillet portion disposed on a corner portion formed by the suction surface and the wall surface of the shroud wall portion, wherein the pressure-surface side fillet portion and the suction-surface side fillet portion are separated at a leading-edge side of the vane portion so as not to connect to each other, wherein an upstream-side end surface of the pressure-surface side fillet portion of the blade or the upstream-side end surface of the suction-surface side fillet portion is located to face one of the corner portions of the outlet portions of the combustors disposed adjacently in the circumferential direction.

2. The first-stage stationary vane of a gas turbine according to claim 1, wherein an upstream-side end portion of the vane portion includes an upstream-side end surface which connects the pressure surface and the suction surface, and wherein the upstream-side end surface includes a flat surface which connects to the shroud wall portion.

3. The first-stage stationary vane of a gas turbine according to claim 2, wherein an upstream-side end surface of the pressure-surface side fillet portion and an upstream-side end surface of the suction-surface side fillet portion are formed so as not to protrude upstream from the flat surface.

4. The first-stage stationary vane of a gas turbine according to claim 1, wherein an upstream-side end surface of the pressure-surface side fillet portion is defined by a curve which smoothly connects the pressure surface and the wall surface of the shroud portion, a first segment which extends from a first end of the curve to the wall surface of the shroud wall portion along a vane height direction, and a second segment which extends from a joint portion between the first segment and the wall surface of the shroud wall portion to a second end of the curve.

5. The first-stage stationary vane of a gas turbine according to claim 1, wherein an upstream-side end surface of the suction-surface side fillet portion is defined by a curve which smoothly connects the suction surface and the wall surface of the shroud portion, a first segment which extends from a first end of the curve to the wall surface of the shroud wall portion along a vane height direction, and a second segment which extends from a joint portion between the first segment and the wall surface of the shroud wall portion to a second end of the curve.

6. The first-stage stationary vane of a gas turbine according to claim 1, wherein at least one of the pressure-surface side fillet portion or the suction-surface side fillet portion includes a fillet radius increasing portion where a fillet radius increases toward an upstream side.

7. A gas turbine, comprising:

a plurality of combustors each of which has an outlet portion including a radial-directional wall portion along a radial direction of a rotor, the plurality of combustors being disposed in a circumferential direction of the rotor; and the first-stage stationary vane according to claim 1 where the upstream-side end surface of the pressure-surface side fillet portion of the blade or the upstream-side end surface of the suction-surface side fillet portion is located to face one of the corner portions of the outlet portions of the combustors disposed adjacently in the circumferential direction.

8. The first-stage stationary vane of a gas turbine according to claim 1, wherein the pressure-surface side fillet portion includes a fillet radius increasing portion where a fillet radius increases toward an upstream side, and at least one of the shroud wall portion or the vane portion includes a cut-out portion which is recessed toward the fillet radius increasing portion from a back side of the fillet radius increasing portion.

9. The first-stage stationary vane of a gas turbine according to claim 1, wherein the suction-surface side fillet portion includes a fillet radius increasing portion where a fillet radius increases toward an upstream side, and at least one of the shroud wall portion or the vane portion includes a cut-out portion which is recessed toward the fillet radius increasing portion from a back side of the fillet radius increasing portion.

10. The first-stage stationary vane according to claim 8, wherein a downstream end of the cut-out portion is positioned at an upstream side of a downstream end of the fillet radius increasing portion in an axial direction.

11. The first-stage stationary vane of a gas turbine according to claim 8, wherein the cut-out portion has a cross-sectional area which is orthogonal to a depth direction and which decreases toward a bottom portion of the cut-out portion in the depth direction.

12. The first-stage stationary vane of a gas turbine according to claim 2, wherein the upstream-side end portion includes a protruding portion that protrudes toward the upstream side from the flat surface, wherein the protruding portion extends along the radial direction of the gas turbine, and connects to the shroud wall portion.

* * * * *